US008609315B2

(12) United States Patent
Yoshida et al.

(10) Patent No.: US 8,609,315 B2
(45) Date of Patent: Dec. 17, 2013

(54) TRANSPARENT TONER, IMAGE FORMING METHOD, AND TONER SET

(75) Inventors: Satoshi Yoshida, Kanagawa (JP); Tsuyoshi Murakami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/556,817

(22) Filed: Jul. 24, 2012

(65) Prior Publication Data

US 2013/0244152 A1 Sep. 19, 2013

(30) Foreign Application Priority Data

Mar. 19, 2012 (JP) ..... 2012-062341

(51) Int. Cl.
*G03G 9/08* (2006.01)

(52) U.S. Cl.
USPC ..... 430/110.3; 430/110.1; 430/110.4; 430/123.41; 430/123.5

(58) Field of Classification Search
USPC ..... 430/110.1, 110.3, 110.4, 123.41, 123.5
See application file for complete search history.

(56) References Cited

U.S. PATENT DOCUMENTS

| | | | |
|---|---|---|---|
| 2009/0016776 | A1 | 1/2009 | Priebe et al. |
| 2009/0111042 | A1 | 4/2009 | Kiyono et al. |

FOREIGN PATENT DOCUMENTS

| | | |
|---|---|---|
| JP | A-9-197714 | 7/1997 |
| JP | A-10-301339 | 11/1998 |
| JP | A-2001-34008 | 2/2001 |
| JP | A-2002-236396 | 8/2002 |
| JP | A-2005-99122 | 4/2005 |
| JP | A-2005-274614 | 10/2005 |
| JP | A-2009-109701 | 5/2009 |
| JP | A-2010-533318 | 10/2010 |

*Primary Examiner* — Peter Vajda
(74) *Attorney, Agent, or Firm* — Oliff and Berridge, PLC

(57) ABSTRACT

A transparent toner includes toner particles having a volume average particle diameter in the range of 18 μm to 28 μm, and satisfying formulae (1) and (2):

$$0.1 \leq Ntb/Nta \times 100 \leq 2.5 \quad (1)$$

$$0 \leq Ntc/Nta \times 100 \leq 1.0 \quad (2)$$

Nta is the number of particles under the measurement conditions satisfying 0.5 μm≤circle-equivalent diameter≤200 μm, and 0.40≤circularity≤1.00; Ntb is the number of particles under the measurement conditions satisfying 0.5×Dta (μm)≤circle-equivalent diameter≤2.5×Dta (μm), and 0.60≤circularity≤0.90; and Ntc is the number of particles under the measurement conditions satisfying 2.5×Dta (μm)≤circle-equivalent diameter≤200 μm, and 0.40≤circularity≤1.00; Dta is the average circle-equivalent diameter under the measurement conditions satisfying 0.5μm≤circle-equivalent diameter≤200 μm, and 0.40≤circularity≤1.00.

17 Claims, No Drawings

TRANSPARENT TONER, IMAGE FORMING METHOD, AND TONER SET

CROSS-REFERENCE TO RELATED APPLICATIONS

This application is based on and claims priority under 35 USC 119 from Japanese Patent Application No. 2012-062341 filed Mar. 19, 2012.

BACKGROUND

1. Technical Field

The present invention relates to a transparent toner, an image forming method, and a toner set.

2. Related Art

In recent years, electrophotographic systems have started to be used in the printing field, and thus, it has been desired to obtain an image giving a particular effect that has been attained in the printing in the related art, in an electrophotographic mode. As one example, there is an approach, in which a transparent resin layer having an image thickness of from about 20 μm to about 100 μm is formed on a color image, giving a visually enhanced impression, which is called thick printing.

The thick printing requires the image thickness to be thick, and has not been investigated actively hitherto in electrophotographic printing.

SUMMARY

According to an aspect of the invention, there is provided a transparent toner including toner particles having a volume average particle diameter in the range of from 18 μm to 28 μm, and satisfying the following formulae (1) and (2):

$$0.1 \leq Ntb/Nta \times 100 \leq 2.5 \quad (1)$$

$$0 \leq Ntc/Nta \times 100 \leq 1.0 \quad (2)$$

wherein Nta is the number of particles under the measurement conditions satisfying 0.5 μm≤circle-equivalent diameter≤200 μm, and 0.40≤circularity≤1.00;

Ntb is the number of particles under the measurement conditions satisfying 0.5×Dta (μm)≤circle-equivalent diameter≤2.5×Dta (μm), and 0.60≤circularity≤0.90; and Ntc is the number of particles under the measurement conditions satisfying 2.5×Dta (μm)≤circle-equivalent diameter≤200 μm, and 0.40≤circularity≤1.00; and Dta is the average circle-equivalent diameter under the measurement conditions satisfying 0.5 μm≤circle-equivalent diameter≤200 μm, and 0.40≤circularity≤1.00.

DETAILED DESCRIPTION

Hereinbelow, the present exemplary embodiments will be described.

(Transparent Toner)

The transparent toner of the present exemplary embodiment has a volume average particle diameter in the range of from 18 μm to 28 μm and satisfies the following formulae (1) and (2):

$$0.1 \leq Ntb/Nta \times 100 \leq 2.5 \quad (1)$$

$$0 \leq Ntc/Nta \times 100 \leq 1.0 \quad (2)$$

wherein

Nta is the number of particles under the measurement conditions satisfying 0.5 μm≤circle-equivalent diameter≤200 μm, and 0.40≤circularity≤1.00;

Ntb is the number of particles under the measurement conditions satisfying 0.5×Dta (μm)≤circle-equivalent diameter≤2.5×Dta (μm), and 0.60≤circularity≤0.90; and Ntc is the number of particles under the measurement conditions satisfying 2.5×Dta (μm)≤circle-equivalent diameter≤200 μm, and 0.40≤circularity≤1.00; and Dta is the average circle-equivalent diameter under the measurement conditions satisfying 0.5 μm circle-equivalent diameter≤200 μm, and 0.40≤circularity≤1.00.

The transparent toner of the present exemplary embodiment is suitably used as an electrostatic charge image developing transparent toner, and particularly preferably as an electrostatic charge image developing transparent toner for thick printing.

The present inventors have found that image gloss and a sharp image edge portion are important factors in the visual impression of a thick image.

The present inventors have studied this, and as a result, they have found a problem that in the case of forming a thick image by a transparent toner having a large particle diameter, a transparent resin layer is formed on an image, which is thick, and therefore, the image structure easily collapses due to the pressure during the transfer, and further, the image structure also easily collapses due to the pressure during the thermal fixing and the sharpness of the image edge portion is damaged.

Even in the case where the transparent toner of the present exemplary embodiment is a toner having a large particle diameter, it is presumed that when it includes a toner having a specific shape, and the content of the toner having a large particle diameter is decreased, that is, the formula (1): 0.1≤Ntb/Nta×100≤2.5 and the formula (2): 0 Ntc/Nta×100≤1.0 are satisfied, the flowability of the toner is suitably decreased, the transporting or mixing properties are not sacrificed while the image structure does not easily collapse due to the pressure during the transfer and the sharpness of an image edge is improved.

The volume average particle diameter of the transparent toner of the present exemplary embodiment is from 18 μm to 28 μm, preferably from 18 μm to 26 μm, and more preferably from 18 μm to 24 μm. Within the above-described ranges, the image thickness of the thick image can be easily formed, the deformation of the image can be suppressed, and a thick printing image having excellent sharpness of an image edge is formed.

As the method for measuring the volume average particle diameters of the transparent toner of the present exemplary embodiment and the color toner as described later, known methods may be used, but a method using a Multisizer II (manufactured by Beckman Coulter, Inc.) as a measurement device to measure the volume average particle diameter of the toner particles is preferably mentioned. Further, in this method, it is preferable to use ISOTON-II (manufacture by Beckman Coulter, Inc.) as an electrolytic solution.

The transparent toner of the present exemplary embodiment satisfies the formulae (1) and (2).

In the present exemplary embodiment, the shape factor distribution, the circle-equivalent diameter, the number of particles, the circularity, and the shape factor are preferably measured using a flow-type particle image analyzer FPIA-3000 (manufactured by Sysmex Corp.). As a specific measurement method, for example, a method may be preferably mentioned in which using an FPIA-3000 (manufactured by Sysmex Corp.), 30 ml of ion exchange water is first put into a 100-ml beaker, two droplets of a surfactant (CONTAMINON, manufactured by Wako Pure Chemical Industries, Ltd.) as a dispersant are added dropwise thereto, 20 mg of a toner is added to the solution and dispersed by ultrasonic dispersion for 3 minutes to prepare a toner dispersion for measurement, for the obtained toner dispersion, measurement is carried out with a measurement number of 4,500 using FPIA-3000, and if necessary, calculation is performed.

Further, as for the circularity, each image analysis is carried out, and statically processed to determine a circularity as an average value calculated by the following formula.

$$\text{Circularity}=\text{Circle-Equivalent Diameter Perimeter}/\text{Perimeter}=[2\times(A\pi)^{1/2}]/PM$$

(wherein A represents a projection area and PM represents a perimeter).

Furthermore, in the case of measuring the shape factor distribution or the like of a toner from a toner to which an external additive is adhered, the measurement may be carried out after removing the external additive from the toner. However, in the method for measuring the shape factor distribution or the like, there is no focus on the external additive, and thus, in the case of measuring the toner to which the external additive is adhered, the difference between the measured value obtained from the toner to which the external additive is adhered and the measured value obtained from the toner from which the external additive is removed is in an error range and the measured value can be regarded as the shape factor distribution or the like of the toner.

It is presumed that most of the toner particles correspond to the particles satisfying:

0.5 μm≤5 circle-equivalent diameter≤200 μm and 0.40≤circularity≤1.00 as a subject for measuring Dta and Nta in the formulae (1) and (2).

It is presumed that in the particles having a volume average particle diameter of from 18 μm to 28 μm, few particles not falling in the range of 0.5 μm≤circle-equivalent diameter≤200 μm are present, and if any, they are present in the proportion of preferably less than 2% by weight, more preferably less than 1% by weight, and even more preferably less than 0.1% by weight, based on the total weight of the toner. Further, the particles having a circularity of less than 0.40 are significantly deformed particles and few of such particles are present, and if any, they are present in the proportion of preferably less than 1% by weight, and more preferably less than 0.1% by weight, based on the total weight of the toner.

In addition, for measurement in the range of 0.5 μm≤circle-equivalent diameter≤200 μm, the shape factor distribution or the like is easily measured in such a range, for example, the shape factor distribution or the like is easily measured by a single measurement or by means of a single device, which is preferred in view of convenience.

It is presumed that as a subject for measuring Ntb, particles satisfying:

0.5×Dta (μm)≤circle-equivalent diameter≤2.5×Dta (μm) and 0.60≤circularity≤0.90 are particles having a circle-equivalent diameter in a specific range including Dta and a few irregularities or the like.

By satisfying the formula (1): 0.1 Ntb/Nta×100≤2.5, a thick printing image having excellent sharpness of an image edge is formed.

Furthermore, the transparent toner of the present exemplary embodiment preferably satisfies the following formula (3), and more preferably the following formula (5). With the exemplary embodiment, a thick printing image having more excellent sharpness of an image edge is formed.

$$0.5\leq Ntb/Nta\times 100\leq 1.5 \quad (3)$$

$$0.8\leq Ntb/Nta\times 100\leq 1.2 \quad (5)$$

Incidentally, Ntb and Nta in the formula (3) or (5) have the same meaning as those in the formula (1).

As a subject for measuring Ntc, particles satisfying:

2.5×Dta (μm)≤circle-equivalent diameter≤200 μm and 0.40≤circularity≤1.00 are particles having a large particle diameter that is equal to or more than 54 μm.

By satisfying the formula (2): 0≤Ntc/Nta×100≤1.0, a thick printing image having excellent sharpness of an image edge is formed.

Furthermore, the transparent toner of the present exemplary embodiment preferably satisfies the following formula (4), and more preferably the following formula (6). With the exemplary embodiment, a thick printing image having more excellent sharpness of an image edge is formed.

$$0\leq Ntc/Nta\times 100\leq 0.5 \quad (4)$$

$$0\leq Ntc/Nta\times 100\leq 0.2 \quad (6)$$

Incidentally, Ntc and Nta in the formula (4) or (6) have the same meaning as those in the formula (2).

Furthermore, the number average particle size distribution index GSDP of the transparent toner of the present exemplary embodiment is preferably equal to or less than 1.50, more preferably from 1.20 to 1.50, even more preferably from 1.20 to 1.35, and particularly preferably from 1.25 to 1.35. With this exemplary embodiment, a thick printing image having more excellent sharpness of an image edge is formed.

Moreover, in the present exemplary embodiment, the value of the number average particle size distribution index GSDP is measured and calculated as follows. First, by using a measurement device such as a Multisizer II (trade name, manufactured by Beckman-Coulter, Inc.), a cumulative distribution is drawn, respectively, with respect to the volume and the number from the side of the smallest diameter against the partitioned particle size range (channel) on the basis of the particle size distribution thus measured. The particle diameter at a cumulative point of 16% with respect to the volume is defined as $D_{16v}$, the particle diameter at a cumulative point of 16% with respect to the number is defined as $D_{16p}$; the particle diameter at a cumulative point of 50% with respect to the volume is defined as $D_{50v}$, the particle diameter at a cumulative point of 50% with respect to the number is defined as $D_{50p}$; and the particle diameter at a cumulative point of 84% with respect to the volume is defined as $D_{84v}$, and the particle diameter at a cumulative point of 84% with respect to the number is defined as $D_{84p}$.

Using these measured values, the volume average particle size distribution index (GSDv) is calculated from the formula $\sqrt{(D_{84v}/D_{16v})}$, the number average particle size distribution index (GSDp) is calculated from the formula $\sqrt{(D_{84P}/D_{16P})}$, and the lower number average particle size distribution index (lower GSDp) is calculated from the formula $\sqrt{(D_{50p}/D_{16p})}$. The particle diameter in the present exemplary embodiment refers to $D_{50v}$ and GSDP refers to the lower number average particle size distribution index (lower GSDp). The aperture diameter is 100 μm and the partition ranges of each channel are from 1.587 to 2.000 μm, from 2.000 to 2.520 μm, from 2.520 to 3.175 μm, from 3.175 to 4.000 μm, from 4.000 to 5.040 μm, from 5.040 to 6.350 μm, from 6.350 to 8.000 μm, from 8.000 to 10.079 μm, from 10.079 to 12.699 μm, from 12.699 to 16.000 μm, from 16.000 to 20.159 μm, from 20.159 to 25.398 μm, from 25.398 to 32.000 μm, from 32.000 to 40.317 μm, from 40.317 to 50.797 μm, and from 50.797 to 64.000 μm.

The content (compositional ratio, % by mole) of the elemental sulfur (hereinafter may be referred to as "S") in the transparent toner of the present exemplary embodiment, as measured by fluorescent X-rays, is preferably from 0.01% to 0.1%, more preferably from 0.02% to 0.08%, even more preferably from 0.03% to 0.06%, and particularly preferably from 0.03% to 0.04%. When the content of the sulfur atoms falls within these ranges, sufficient liquid bridge force among the toner particles is obtained and the defect of the image by the transfer pressure and the heat fixing pressure can be suppressed, and accordingly, a thick printing image having more excellent sharpness of an image edge is formed.

Further, the content of elemental sulfur represents a compositional ratio, that is, the proportion (% by mole) of the number of sulfur atoms with respect to the number of all the elements measured.

It is thought that the elemental sulfur included in the transparent toner of the present exemplary embodiment and the color toner as described later is included in a toner due to a variety factors. For example, a case where a binder resin and other components themselves have elemental sulfur or a case where elemental sulfur is contained as an impurity of the binder resin or other components may be presumed.

Among these, the transparent toner of the present exemplary embodiment preferably contains a surfactant having sulfur atoms. Further, the surfactant having sulfur atoms is more preferably a sulfonate compound, and even more preferably a disulfonate compound. This shall apply to the color toner as described later.

As an X-ray fluorescence analysis method for measuring the content of the elemental sulfur in the toner, for example, the content of the elemental sulfur can be determined by quantitative analysis under the measurement conditions of a tube voltage of 40 kV, a tube current of 70 mA, a measurement time of 15 minutes, and a measurement area of a diameter 10 mm (a sample in an amount of 0.3 g is shaped into a cylinder with a diameter of 10 mm), using an XRF-1500 (manufactured by Shimadzu Corporation) as a measurement device.

It is preferable that the transparent toner of the present exemplary embodiment contain a binder resin and substantially do not contain a colorant.

Herein, substantially not containing a colorant means that the content of the colorant in the transparent toner is 1% by weight or less, preferably 0.1% by weight or less, and more preferably zero, based on the entire transparent toner. Further, coloration by a trace amount of impurities or slight coloration by the respective components included in the transparent toner is tolerable. In addition, from the viewpoint of color adjustment, the transparent toner may contain an extremely small amount of a colorant, for example, a slight amount of color pigments may be added, and from the viewpoint of maintenance of the brightness of the image, the colorant may be used with a range of 1% by weight or less, but it is preferable that the colorant be not contained.

Furthermore, it is more preferable that the binder resin in the transparent toner of the present exemplary embodiment contain a polyester resin, and it is more preferable that the binder resin be a polyester resin.

<Binder Resin>

The transparent toner of the present exemplary embodiment preferably contains at least a binder resin.

Examples of the binder resins include homopolymers and copolymers of styrenes such as styrene and chlorostyrene; monoolefins such as ethylene, propylene, butylene, and isoprene; vinyl esters such as vinyl acetate, vinyl propionate, vinyl benzoate, and vinyl acetate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone.

In particular, typical examples of the binder resin include a polystyrene resin, a styrene-alkyl acrylate copolymer, a styrene-alkyl methacrylate copolymer, a styrene-acrylonitrile copolymer, a styrene-butadiene copolymer, a styrene-maleic anhydride copolymer, a polyethylene, and a polypropylene. Other examples include a polyester resin, a polyurethane resin, an epoxy resin, a silicone resin, a polyamide resin, a modified rosin resin, paraffin, and waxes. Among these, the polyester resin is particularly preferred.

The polyester resin employed in the present exemplary embodiment is synthesized by polycondensation of a polyol component and a polycarboxylic acid component. Further, in the present exemplary embodiment, either commercially available polyester resins or suitably synthesized polyester resins may be used as the polyester resin.

Examples of the polyvalent carboxylic acid component include, but are not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids such as dibasic acids such as phthalic acid, isophthalic acid, terephthalic acid, naphthalene-2,6-dicarboxylic acid, malonic acid, and mesaconic acid, as well as anhydrides thereof or lower alkyl esters thereof.

Examples of trivalent or higher-valent carboxylic acids include 1,2,4-benzenetricarboxylic acid, 1,2,5-benzenetricarboxylic acid, 1,2,4-naphthalenetricarboxylic acid, and anhydrides or lower alkyl esters thereof. These may be used singly or in combinations of two or more kinds thereof.

Furthermore, in addition to the above-described aliphatic dicarboxylic acids or aromatic dicarboxylic acids, it is more preferable that a dicarboxylic acid component having an ethylenically unsaturated double bond be contained. The dicarboxylic acid having an ethylenically unsaturated double bond achieves radical crosslinking bond via an ethylenically unsaturated double bond, so that it is suitably used for the purpose of preventing hot offset at the time of fixing. Examples of such a dicarboxylic acid include maleic acid, fumaric acid, 3-hexenedioic acid, and 3-octenedioic acid. However, such a dicarboxylic acid is not limited thereto. Also, lower alkyl esters or acid anhydrides thereof are exemplified. Among these, in view of costs, fumaric acid, maleic acid, or the like is preferred.

As for the polyol component, examples of the dihydric alcohol include alkylenes (number of carbon atoms: 2 to 4) oxide adducts of bisphenol A (average addition molar number: 1.5 to 6) such as polyoxypropylene (2.2)-2,2-bis(4-hydroxyphenyl)propane and polyoxyethylene (2.2)-2,2-bis(4-hydroxyphenyl)propane, ethylene glycol, propylene glycol, neopentyl glycol, 1,4-butanediol, 1,3-butanediol, and 1,6-hexanediol.

Examples of the trihydric or higher-hydric polyalcohols include sorbitol, pentaerythritol, glycerol, and trimethylolpropane.

As for an amorphous polyester resin (also referred to as a "non-crystalline polyester resin"), among the foregoing raw material monomers, dihydric or higher-hydric secondary alcohols and/or divalent or higher-valent aromatic carboxylic acid compounds are preferable. Examples of the dihydric or higher-hydric secondary alcohol include a propylene oxide adduct of bisphenol A, propylene glycol, 1,3-butanediol, and glycerol. Among these, a propylene oxide adduct of bisphenol A is preferred.

As the divalent or higher-valent aromatic carboxylic acid compound, terephthalic acid, isophthalic acid, phthalic acid, and trimellitic acid are preferred, and terephthalic acid and trimellitic acid are more preferred.

Moreover, for the purpose of imparting low-temperature fixability to the toner, it is preferable to use a crystalline polyester resin in a part of the binder resin.

The crystalline polyester resin is preferably constituted with an aliphatic dicarboxylic acid and an aliphatic diol, and more preferably constituted with a linear dicarboxylic acid and a linear aliphatic diol, in each of which the number of carbon atoms in a main chain segment thereof is from 4 to 20. In the case of a linear-type, because of excellent crystallinity and an appropriate crystalline melting temperature of the polyester resin, the toner blocking resistance, the image storability, and the low-temperature fixability are excellent. Further, in the case where the number of carbon atoms is 4 or more, the polyester resin is low in terms of the ester bond concentration, adequate in electrical resistance and excellent in toner chargeability. Further, in the case where the number of carbon atoms is 20 or less, practically usable materials are easily available. The number of carbon atoms is more preferably 14 or less.

Examples of the aliphatic dicarboxylic acid that are suitably used for the synthesis of the crystalline polyester include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters or acid anhydrides thereof. However, it should not be construed that the invention is limited thereto. Among these, taking into consideration easiness of availability, sebacic acid or 1,10-decanedicarboxylic acid is preferred.

Specific examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. However, it should not be construed that the invention is limited thereto. Among these, taking into consideration easiness of availability, 1,8-octanediol, 1,9-nonanediol, or 1,10-decanediol is preferred.

Examples of the trihydric or higher-hydric polyalcohol include glycerin, trimethylolethane, trimethylolpropane, and pentaerythritol. These materials may be used singly or in combinations of two or more kinds thereof.

The content of the aliphatic dicarboxylic acid in the polyvalent carboxylic acid is preferably equal to or more than 80% by mole, and more preferably equal to or more than 90% by mole. When the content of the aliphatic dicarboxylic acid is 80% by mole or more, because of excellent crystallinity and adequate melting temperature of the polyester resin, the toner blocking resistance, the image storability, and the low-temperature fixability are excellent.

The content of the aliphatic diol in the polyol component is preferably equal to or more than 80% by mole, and more preferably equal to or more than 90% by mole. When the content of the aliphatic dial is 80% by mole or more, because of excellent crystallinity and adequate melting temperature of the polyester resin, the toner blocking resistance, the image storability, and the low-temperature fixability are excellent.

In the present exemplary embodiment, the melting temperature Tm of the crystalline polyester resin is preferably from 50° C. to 100° C., more preferably from 50° C. to 90° C., and even more preferably from 50° C. to 80° C. Within the above-described ranges, release properties and low-temperature fixability are excellent, and further, offset can be reduced, which is thus preferable.

Herein, for the measurement of the melting temperature of the crystalline polyester resin, the melting temperature can be determined as a melting peak temperature in the power compensation-type differential scanning calorimetry as defined in JIS K-7121:87 when measurement is made at a heating rate of 10° C. per min from room temperature (20° C.) to 180° C. by using a differential scanning calorimeter. Further, crystalline polyester resins may exhibit plural melting peaks in some cases, but in the present exemplary embodiment, the maximum peak is regarded as the melting temperature.

Meanwhile, the glass transition temperature (Tg) of the amorphous polyester resin is preferably equal to or higher than 30° C., more preferably from 30° C. to 100° C., and even more preferably from 50° C. to 80° C. When the glass transition temperature (Tg) of the amorphous polyester resin falls within these ranges, the amorphous polyester resin is in a glass state when used, and accordingly, there is no case where the toner particles are aggregated by the heat or pressure applied during the image formation, or the particles are adhered and deposited on the machine, thereby obtaining stable image forming performance over a long period of time.

Herein, the glass transition temperature of the amorphous polyester resin refers to a value measured by a method as defined in ASTM D3418-82 (DSC method).

Further, the glass transition temperature in the present exemplary embodiment can be measured by using a differential scanning calorimeter, for example, "DSC-20" (manufactured by Seiko Instruments Inc.), and specifically, by heating about 10 mg of a sample at a constant heating rate (10° C./min) and obtaining a glass transition temperature from the intersection between the base line and the slope in the endothermic peak.

The weight average molecular weight of the crystalline polyester resin is preferably from 10,000 to 60,000, more preferably from 15,000 to 45,000, and even more preferably from 20,000 to 30,000.

Further, the weight average molecular weight of the amorphous polyester resin is preferably from 5,000 to 100,000, more preferably from 10,000 to 90,000, and even more preferably from 20,000 to 80,000.

If the weight average molecular weight of the crystalline polyester resin and the amorphous polyester resin are within the respective ranges of numerical values, the image strength is preferably compatible with the fixability. The weight average molecular weight can be obtained by the measurement of molecular weights in accordance with a gel permeation chromatography (GPC) method of the fraction soluble in tetrahydrofuran (THF). The molecular weight of the resin is calculated using the fraction soluble in THF, using a TSK-GEL (GMH (manufactured by Tosoh Corporation)) column or the like, measuring with the use of THF as a solvent, and using a molecular weight calibration curve prepared by monodisperse polystyrene standard samples.

The acid values of the crystalline polyester resin and the amorphous polyester resin are each preferably from 1 mg KOH/g to 50 mg KOH/g, more preferably from 5 mg KOH/g to 50 mg KOH/g, and even more preferably from 8 mg KOH/g to 50 mg KOH/g. The acid values of the crystalline polyester resin and the amorphous polyester resin falling within these ranges are preferable since the fixing characteristics and the charge stability are excellent.

In addition, if necessary, for the purpose of adjusting the acid value or the hydroxyl value, a monovalent acid such as acetic acid and benzoic acid, or a monohydric alcohol such as cyclohexanol benzyl alcohol is also used.

A method for preparing the polyester resin is not particularly limited, and the polyester resin may be prepared by a general polyester polymerization method for allowing an acid component and an alcohol component to react with each other. Examples thereof include a direct polycondensation method and an ester interchange method, and different methods are used depending upon the kinds of the monomers for preparing the polyester resin. Further, a polycondensation catalyst such as a metal catalyst and a Bronsted acid catalyst is preferably used.

The polyester resin may be prepared by subjecting the polyol and the polyvalent carboxylic acid to a condensation reaction in the usual manner. For example, the polyester resin is prepared by adding and blending the polyol and the polyvalent carboxylic acid, and optionally, a catalyst in a reaction vessel equipped with a thermometer, a stirrer, and a flow-down-type condenser; heating the mixture at from 150° C. to 250° C. in the presence of an inert gas (a nitrogen gas or the like), thereby continuously removing low-molecular-weight compounds as by-products out of the reaction system; and stopping the reaction at a point of time of reaching a predetermined acid value, followed by cooling to obtain a desired reaction product.

Moreover, the content of the binder resin in the transparent toner of the present exemplary embodiment is not particularly limited, but is preferably from 75% by weight to 99.5% by weight, more preferably from 85% by weight to 99% by weight, and even more preferably from 90% by weight to 99% by weight, based on the total weight of the electrostatic charge image developing toner. When the content of the binder resin falls within theses ranges, the fixability, the storability, the powder characteristics, and the charge characteristics are excellent.

<Release Agent>

The transparent toner of the present exemplary embodiment preferably contains at least a release agent.

The release agent that is used in the present exemplary embodiment is not particularly limited, and known materials are used, and those obtained from waxes as follows are preferred. That is, examples of the waxes include a paraffin wax and derivatives thereof, a montan wax and derivatives thereof, a microcrystalline wax and derivatives thereof, a Fischer-Tropsch wax and derivatives thereof, and a polyolefin wax and derivatives thereof. The derivatives include an oxide, a polymer with a vinyl monomer, and a graft modified product. Besides, alcohols, fatty acids, plant waxes, animal waxes, mineral waxes, ester waxes, acid amides, or the like may also be used.

It is preferable that the wax which is used as the release agent melt at any temperature of from 70° C. to 140° C. and have a melt viscosity of from 1 centipoise to 200 centipoises. It is more preferable that the wax have a melt viscosity of from 1 centipoise to 100 centipoises. When the temperature at which the wax melts is equal to or higher than 70° C., the temperature at which the wax varies is sufficiently high, and the blocking resistance and the developability when the temperature within a copier increases are excellent. When the temperature at which the wax melts is equal to lower than 140° C., the temperature at which the wax varies is sufficiently low, it is not necessary to perform fixing at high temperatures, and the energy saving is excellent. Also, when the melt viscosity of the wax is equal to or less than 200 centipoises, elution of the wax from the toner is adequate, and the fixing releasability is excellent.

Furthermore, the content of the release agent is preferably from 3% by weight to 60% by weight, more preferably from 5% by weight to 40% by weight, and even more preferably from 7% by weight to 20% by weight, based on the total weight of the toner. When the content of the release agent falls within these ranges, the toner offset-preventing properties onto a heating member are excellent, and also, the feed roll contamination-preventing properties are excellent.

<Other Toner Additives>

In addition to the components as described above, various components such as an internal additive, a charge-controlling agent, and external additives may be added to the transparent toner of the present exemplary embodiment, as needed. Further, the catalyst or the surfactant as described later, residues thereof, or the like may also be incorporated.

Examples of the internal additive include magnetic materials of metals or alloys such as ferrite, magnetite, reduced iron, cobalt, nickel, and manganese; and compounds containing such metals, provided that since these materials are often colored, use thereof is limited to a range where the transparency of the transparent toner is not deteriorated.

Examples of the charge-controlling agent include quaternary ammonium salt compounds, nigrosine based compounds, dyes composed of a complex of aluminum, iron, chromium, or the like, and triphenylmethane-based pigments.

Further, the external additive is added to the parent particles of the toner mainly for the purpose of adjusting the viscoelasticity of the toner, and examples thereof include all inorganic particles which are usually used as an external additive for the surface of a toner and which are enumerated below in detail, such as silica, alumina, titania, calcium carbonate, magnesium carbonate, calcium phosphate, and cerium oxide.

Furthermore, the shape factor SF1 (=(the absolute maximum length of the diameter of the toner)$^2$/the projection area of the toner)×(π/4)×100) of the transparent toner of the present exemplary embodiment is preferably in the range of 110 to 160, and more preferably in the range of 110 to 140.

Incidentally, the value of the shape factor SF1 represents the roundness of the toner, and the value is 100 where the toner represents a perfect circle and increases as the shape of the toner becomes irregular. Further, the values required for calculation using the shape factor SF1, that is, the absolute maximum length of the toner diameter and the projection area of the toner, are obtained by photographing an image of the toner particles enlarged by 500-fold magnification using an optical microscope (Microphoto-FXA, manufactured by Nikon Corporation), and subjecting the obtained information of the image to image analysis by putting the information into an image analysis device (Luzex III, manufactured by Nireco Corporation) via an interface. The average value of the shape factors SF1 is calculated based on the data obtained by measuring 1,000 toner particles that are randomly sampled.

When the shape factor SF1 is equal to or more than 110, generation of the residual toner in the transfer step during the image formation is suppressed, and the cleaning property during the cleaning of the residual toner using a blade or the like is excellent, and as a result, the image defect is decreased. On the other hand, when the shape factor SF1 is equal to or less than 160, the toner is prevented from being broken by collision with a carrier in a developing device where the toner is used as a developer. As a result, generation of fine powder is suppressed, whereby the surface of the photoreceptor and the like are prevented from being contaminated by the release agent component exposed on the toner surface. This leads to excellent charging characteristics and suppression of generation of fog due to the fine powder.

<Method for Preparing Transparent Toner>

The method for preparing the transparent toner of the present exemplary embodiment is not particularly limited as long as the transparent toner of the present exemplary embodiment can be obtained. For example, a kneading and pulverizing method in which a binder resin, optionally, a release agent, and a charge-controlling agent or the like are mixed and kneaded, ground, and classified; a method of changing the shape of the particles obtained by the kneading and pulverizing method, using mechanical impact force or heat energy; an emulsion polymerization aggregation method in which a dispersion obtained by emulsion-polymerizing polymerizable monomers of a binder resin is mixed with a dispersion containing a release agent, and optionally a charge-controlling agent and the like, and the resulting mixture is aggregated, heated, and coalesced to obtain toner particles; a polyester aggregating method in which a dispersion obtained by emulsifying a polyester resin is mixed with a dispersion containing a release agent, and optionally a charge-controlling agent and the like, and the resulting mixture is aggregated, heated, and coalesced to obtain toner particles; a suspension polymerization method in which polymerizable monomers to obtain a binder resin and a solution containing a release agent, and optionally a charge-controlling agent and the like, are suspended in an aqueous solvent and polymerized therein; and a dissolution suspension method in which a binder resin and a solution containing a release agent, and optionally a charge-controlling agent and the like, are suspended in an aqueous solvent to form particles, may be used. Moreover, a method for preparing a toner having a core-shell structure in which aggregated particles are further attached to the toner particles obtained by the above-described method, as a core, and then heated and coalesced may be used.

Among these, a kneading and pulverizing method, an emulsion polymerization aggregation method, or a polyester aggregation method is preferably used to prepare toner particles, and a polyester aggregation method is more preferably used to prepare toner particles.

Furthermore, the method for preparing the transparent toner of the present exemplary embodiment includes an aggregation step of at least aggregating transparent resin particles in an aqueous medium to obtain aggregated particles; and a coalescence step of coalescing the aggregated particles by heating to obtain a transparent toner. Further, when the glass transition temperature of a composition obtained by mixing raw materials excluding the external additive of the toner at a compositional ratio of the toner, which is measured by a differential scanning calorimeter, is denoted as Mg, aggregation is particularly preferably carried out in the temperature range of from (Mg+10° C.) to (Mg+30° C.), and in the temperature range of from 45° C. to 70° C. in the aggregation step.

<Aggregation Step>

The method for preparing the transparent toner of the present exemplary embodiment preferably includes an aggregation step of at least aggregating transparent resin particles in an aqueous medium to obtain aggregated particles.

Furthermore, in the aggregation step, when the glass transition temperature of a composition obtained by mixing raw materials excluding the external additive of the toner at a compositional ratio of the toner, which is measured by a differential scanning calorimeter, is denoted as Mg, aggregation is more preferably carried out in the temperature range of from (Mg+10° C.) to (Mg+30° C.), and in the temperature range of from 45° C. to 70° C.

In addition, in the aggregation step, the aqueous medium preferably contains a surfactant having sulfur atoms, which improves the dispersibility of the respective toner materials, and more preferably an anionic surfactant having sulfur atoms.

The present inventors have found that in the case where aggregation is carried out in an aqueous medium containing a surfactant, aggregation is performed as the aqueous medium containing a surfactant is adsorbed, and as a result, the surfactant remains in the toner although the amount thereof is small. Particularly, in the case where a polyester resin is used for the binder resin, the ester group in the polyester resin is strongly hydrophilic and thus, the surfactant significantly remains.

The present inventors have performed extensive studies on this mechanism, and as a result, they have found that the following process can reduce the residual amount of the surfactant.

First, in the method in the related art, in the aggregation step, the aggregated particles are generated while water including the surfactant is adsorbed. In the method in the related art, it is presumed that the coalescence step is carried out after increasing the pH so as to stop the particle diameter growth in the state as described above, but the increased pH makes the aggregation particle more hydrophilic and the coalescence step is conducted while the amount of the surfactant adsorbed increases, and as a result, the surfactant remains in the toner.

On the other hand, it is presumed that when the aggregated particles are generated while water including the surfactant is adsorbed in the aggregation step, when the glass transition temperature of a composition obtained by mixing raw materials excluding the external additive of the toner at a compositional ratio of the toner, which is measured by means of DSC, is denoted as Mg, even in the aggregation step, the aggregation temperature may be controlled to a temperature range of from (Mg+10° C.) to (Mg+30° C.) to start coalescence of the binder resin at a temperature higher than the glass transition temperature, and as a result, even when the coalescence step is conducted after increasing the pH so as to stop the particle diameter growth, the residual amount of the surfactant decreases.

It is also presumed that since the temperature during the aggregation is high, the increase in the kinetic energy of the molecules results in the decrease in the surface tension, and thus, the aggregated particles become less hydrophilic and the amount of the surfactant adsorbed is decreased. In order to use the mechanism for decreasing the surface tension due to the increase in the kinetic energy of the molecules, the absolute value of the temperature is preferably equal to or higher than 45° C., while from the viewpoint of prevention of unstable aggregation due to the decreased surface tension, the absolute value of the temperature is preferably equal to or lower than 70° C.

That is, the aggregation step is preferably a step in which the aggregation is carried out as well as a part of the binder resin is coalesced.

Furthermore, the aggregation temperature is more preferably equal to or higher than 50° C., and particularly preferably equal to or higher than 55° C.

In addition, the aggregation temperature is more preferably in the temperature range of from (Mg+15° C.) to (Mg+30° C.), and even more preferably in the temperature range of from (Mg+20° C.) to (Mg+30° C.).

As the aggregation agent used in the aggregation step, a divalent or higher-valent metallic complex is preferably used in addition to a surfactant having an opposite polarity to that of the surfactant used as a dispersant in any of various dispersions, and an inorganic metallic salt.

In particular, in the case of using the inorganic metal salt, the amount of the surfactant used can be reduced and the charge characteristics can be enhanced. Therefore, the use of the inorganic metal salt is particularly preferred.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. In particular, aluminum salts and polymers thereof are preferred. In order to obtain a narrower particle size distribution, the valence of the inorganic metal salt is suitably divalent rather than monovalent, trivalent rather than divalent, and tetravalent rather than trivalent. Even with the same valence, a polymerization-type inorganic metal salt polymer is more suitable.

In the method for preparing the transparent toner in the present exemplary embodiment, a chelating agent is preferably added to the aggregated particles at the latest immediately before starting the coalescence. By adding a chelating agent to the aggregated particles before the coalescence, the chelating agent is coordinated to the metal ions put into the aggregated particles for aggregation in the aggregation step, the chelate-coordinated metal ions are removed out of the toner in the later washing step, and consequently, the content of the metal ions in the toner can be reduced.

Moreover, as the chelating agent, a water-soluble chelating agent is preferably used.

Examples of the chelating agent include oxycarboxylic acids such as tartaric acid, citric acid, and gluconic acid; iminodiacetic acid (IDA), nitrilotriacetic acid (NTA), ethylenediaminetetraacetic acid (EDTA), and 3-hydroxy-2,2'-iminodisuccinic acid (HIDS).

The amount of the chelating agent added is, for example, in the range of from 0.01 part by weight to 5.0 parts by weight, based on 100 parts by weight of the binder resin.

<Coalescence Step>

The method for preparing the transparent toner of the present exemplary embodiment preferably includes a coalescence step of coalescing the aggregated particles by heating to obtain a transparent toner.

In the coalescence step, the aggregated particles are preferably coalesced by heating to a temperature equal to or higher than the aggregation temperature. Further, in the coalescence step, it is preferable to stop the progress of the aggregation by raising the pH of the suspension of the aggregated particles to a range of 4 to 10, and more preferably of 8 to 10, under the stirring conditions as defined for the aggregation step. As the alkaline solution used for raising the pH, an aqueous NaOH solution is preferred. The aqueous NaOH solution is less volatile and highly stable, as compared with other alkaline solutions, for example, an ammonia solution. Further, the aqueous NaOH solution is excellent in solubility in water, and thus, may be added in a small amount, and is also excellent in an ability to stop the aggregation, as compared with divalent alkaline solutions such as $Ca(OH)_2$.

As heating time in the coalescence step, a time required for achieving coalescence between the particles may be used, and is preferably from 0.5 hour to 10 hours. The aggregated particles after coalescing are cooled to obtain coalesced particle. Further, at a time of cooling, the release agent or the binder resin may be inhibited from recrystallization, thereby suppressing the surface exposure, by raising the cooling rate at around the melting temperature (a range of the melting temperature±10° C.) of the release agent or the binder resin, which is called quenching.

—Other Steps—

After completion of the coalescence step, a desired toner may be obtained by carrying out any of a washing step, a solid-liquid separation step, a drying step, an external addition step, and the like.

It is preferable to sufficiently carry out replacement cleaning with ion exchange water in the cleaning step from the viewpoint of charging properties. Further, the solid-liquid separation step is not particularly limited, but it is preferable to use suction filtration, pressurized filtration, or the like, from the viewpoint of productivity. In addition, the drying step is not particularly limited in terms of the method, but a freeze drying method, a flash jet drying method, a fluidized drying method, a vibration-type fluidized drying method, or the like is preferably used, from the viewpoint of productivity.

In the external addition step, the method for externally adding an external additive to the toner is not particularly limited, and known methods including, for example, attachment methods using a mechanical method or a chemical method may be used. Specific examples thereof include a method in which an external additive is attached to the surface of toner parent particles using a mixer such as a V blender and a Henschel mixer, a method in which an external additive is dispersed in a liquid and then added to a toner in a slurry state, followed by drying and attaching to the surface, and a method of drying the slurry while spraying on the dry toner as a wet method.

It is necessary for the toner of the present exemplary embodiment to satisfy the following formulae (1) and (2):

$$0.1 \leq Ntb/Nta \times 100 \leq 2.5 \quad (1)$$

$$0 \leq Ntc/Nta \times 100 \leq 1.0 \quad (2)$$

(wherein the circle-equivalent diameter is denoted as Dta and the number of particles is denoted as Nta as measured under the measurement conditions satisfying 0.5 μm circle-equivalent diameter≤200 μm and 0.40≤circularity≤1.00; the number of particles is denoted as Ntb as measured under the measurement conditions satisfying 0.5×Dta (μm)≤circle-equivalent diameter≤2.5×Dta (μm) and 0.60≤circularity 0.90; and the number of particles is denoted as Ntc as measured under the measurement conditions satisfying 2.5×Dta (μm) ≤circle-equivalent diameter≤200 μm and 0.40≤circularity≤1.00).

In order to prepare such a toner, the following method may be employed.

First, the transparent toner as a main member, in which the circle-equivalent diameter is Dta, is prepared by the above-described method. Next, the transparent toner satisfying 0.5×Dta (μm)≤circle-equivalent diameter≤2.5×Dta (μm) is prepared by the method above to give a circularity falling in 0.60≤circularity≤0.90, and mixed in a predetermined amount with the transparent toner as the main member. As the method for preparing the toner to be mixed, the same method as the method for preparing the transparent toner as the main member may be used, and the toner may be prepared by adjusting the temperature, the pH, or the time in the step.

Alternatively, in the coalescence step in the preparation of the transparent toner, coalescence between the toner particles may be intentionally generated by lowering the pH at the same time as the start of the coalescence step, thereby generating irregular particles.

(Toner Set)

The toner set of the present exemplary embodiment includes the transparent toner of the present exemplary embodiment and the color toner, and when the volume average particle diameter of the color toner is denoted as Dc and the volume average particle diameter of the transparent toner is denoted as Dt, the toner set satisfies the following formulae:

$$3\ \mu m \leq Dc \leq 8\ \mu m \quad (7)$$

$$18\ \mu m \leq Dt \leq 28\ \mu m \quad (8)$$

$$3 \leq Dt/Dc \leq 8 \quad (9)$$

and in the shape factor distribution of the color toner, the proportion of particles having a circularity of from 0.7 to 0.9 is zero or equal to or less than 0.5% by number.

Further, the volume average particle diameter, the shape factor distribution, the circularity, and the like of the color toner are measured in the same manner as for the volume average particle diameter, the shape factor distribution, the circularity, and the like of the transparent toner as described above.

Moreover, the toner set of the present exemplary embodiment is preferably used as an electrostatic charge image developing toner set, and particularly preferably as an electrostatic charge image developing toner set for thick printing.

For the toner set of the present exemplary embodiment, the transparent toner and the color toner of the present exemplary embodiment satisfy 3 μm≤Dc≤8 μm, 18 μm≤Dt≤28 μm, and 3≤Dt/Dc≤8.

The volume average particle diameter of the color toner in the toner set of the present exemplary embodiment is from 3 μm to 8 μm, and preferably from 3 μm to 6 μm. When the volume average particle diameter is within the above-described ranges, the aggregation force among the particles of the color toner is increased, and during the transfer, the mixed color of the color toner and the transparent toner at the interface of the transparent resin layer is suppressed.

Furthermore, the toner set of the present exemplary embodiment satisfies 3≤Dt/Dc≤8, preferably 3≤Dt/Dc≤6, more preferably 3≤Dt/Dc≤5, and even more preferably 3.5≤Dt/Dc≤4.5. When the toner set falls in the ranges, the image density formed by the color toner is suitable, generation of the mixed color with the transparent toner is suppressed, and accordingly, particularly, a sharp image in the edge portion of an image receiving a large effect can be obtained and the visual impression of the image becomes stronger.

For the color toner in the toner set of the present exemplary embodiment, the proportion of particles having a circularity of from 0.7 to 0.9 is zero or equal to or less than 0.5% by number, preferably zero or equal to or less than 0.3% by number, and more preferably zero or equal to or less than 0.1% by number, in the shape factor distribution. With the exemplary embodiment, a thick printing image having excellent sharpness of an image edge is formed.

The transparent toner in the toner set of the present exemplary embodiment is the transparent toner of the present exemplary embodiment as described above, and its preferred exemplary embodiments are also the same.

The toner set of the present exemplary embodiment may have two or more kinds of the transparent toner, but it preferably has a single kind of the transparent toner.

For the color toner in the toner set of the present exemplary embodiment, other components, which contain a colorant, preferably in an amount equal to or more than 1% by weight, are the same components as for the transparent toner of the present exemplary embodiment as described above and their preferred exemplary embodiments are also the same.

In the case where the toner set of the present exemplary embodiment contains two or more kinds of the color toner, it is sufficient that the above-described requirements for the volume average particle diameter and the circularity with the transparent toner are satisfied by at least one kind of the color toner satisfies the requirements, but all the color toners included in the toner set preferably satisfy the above-described requirements for the volume average particle diameter and the circularity with the transparent toner.

The toner set of the present exemplary embodiment preferably contains a yellow toner, a magenta toner, and a cyan toner as the color toner, and more preferably contains a yellow toner, a magenta toner, a cyan toner, and a black toner.

In the toner set of the present exemplary embodiment, the number average particle size distribution index GSDPc of the color toner and the number average particle size distribution index GSDPt of the transparent toner satisfy 1.03<GSDPt/GSDPc<1.15, preferably 1.03<GSDPt/GSDPc<1.10, and more preferably 1.04<GSDPt/GSDPc<1.09. When the number average particle size distribution index GSDPc of the color toner and the number average particle size distribution index GSDPt of the transparent toner fall in the ranges, the mixed color of the color toner and the transparent toner is suppressed, and particularly, a sharper image in the edge portion of an image receiving a large effect can be obtained and the visual impression of the image becomes stronger.

In the toner set of the present exemplary embodiment, when the content (compositional ratio) of elemental sulfur of the transparent toner as measured by fluorescent X-rays is denoted as St and the content (compositional ratio) of elemental sulfur of the color toner as measured by fluorescent X-rays is denoted as Sc, the proportion of the sulfur content St/Sc satisfies the relationship of the following formula (10), that is, the proportion of the sulfur content St/Sc is preferably from 0.1 to 1.0, more preferably from 0.1 to 0.7, even more preferably from 0.2 to 0.5, and particularly preferably from 0.3 to 0.4.

$$0.1 \leq St/Sc \leq 1.0 \quad (10)$$

When the proportion of the sulfur content St/Sc falls in these ranges, the toner image formed by the color toner has a stronger liquid bridge force than that of the transparent toner layer, and plays the same role as the base supporting the transparent toner layer, thereby suppressing the collapse of the image.

Furthermore, the content of the elemental sulfur (compositional ratio, % by mole) of the color toner of the present exemplary embodiment, as measured by fluorescent X-rays, is preferably from 0.02% to 0.30%, more preferably from 0.05% to 0.20%, and even more preferably from 0.08% to 0.15%.

<Colorant>

The colored toner used in the present exemplary embodiment contains a colorant.

The colorant is not particularly limited and known colorants may be used. Specifically, typical examples thereof include carbon black, nigrosine, Aniline Blue, Calco Oil Blue, Chromium Yellow, Ultramarine Blue, Du Pont Oil Red, Quinoline Yellow, Methylene Blue Chloride, Phthalocyanine Blue, Malachite Green Oxalate, lamp black, rose bengal, C. I. Pigment Red 48:1, C. I. Pigment Red 122, C. T. Pigment Red 57:1, C. I. Pigment Red 238, C. I. Pigment Yellow 97, C. I. Pigment Yellow 12, C. I. Pigment Yellow 180, C. I. Pigment Blue 15:1, and C. I. Pigment Blue 15:3.

The colorant may be used singly or in combinations of two or more kinds thereof.

In the colored toner used in the present exemplary embodiment, the colorant is chosen from the viewpoints of hue angle, color saturation, lightness, weather resistance, OHP transmissivity, and dispersibility in the colored toner. The addition amount of the colorant is not particularly limited, but it is suitably in the range of from 3% by weight to 60% by weight with respect to the total weight of the colored toner.

(Electrostatic Charge Image Developer and Electrostatic Charge Image Developer Set)

The transparent toner of the present exemplary embodiment is suitably used as an electrostatic charge image developer.

The electrostatic charge image developer of the present exemplary embodiment is not particularly limited, as long as it contains the transparent toner of the present exemplary embodiment, and it can take a proper component composition depending upon the purpose. When the electrostatic charge image developing toner of the present exemplary embodiment is used singly, an electrostatic charge image developer of a single-component system is prepared, and when the electrostatic charge image developing toner of the present exemplary embodiment is used in combination with a carrier, an electrostatic charge image developer of a two-component system is prepared.

As for the single-component developer, a method in which frictional electrification with a developing sleeve or charge member is performed to form a charged toner, followed by performing developing depending upon an electrostatic latent image is also applied.

Furthermore, the toner set of the present exemplary embodiment is suitably used as an electrostatic charge image developer set. For example, the transparent toner and the color toner in the toner set of the present exemplary embodiment may be used as they are as a single-component developer or may be used in combination with each carrier as a two-component developer.

In the present exemplary embodiment, though the development system is not particularly specified, a two-component development system is preferred. Further, so far as the condition is satisfied, the carrier is not particularly specified. However, examples of a core material of the carrier include magnetic metals such as iron, steel, nickel, and cobalt; alloys thereof with manganese, chromium, a rare earth or the like; and magnetic oxides such as ferrite and magnetite. From the viewpoints of core material surface properties and core material resistance, an alloy thereof with ferrite, particularly manganese, lithium, strontium, magnesium, or the like is preferred.

The carrier used in the present exemplary embodiment is preferably one obtained by coating a resin on the core material surface. The resin is not particularly limited and is properly chosen depending upon the purpose. Examples thereof include known resins, such as polyolefin-based resins such as polyethylene and polypropylene; polyvinyl-based resins and polyvinylidene-based resins such as polystyrene, acrylic resins, polyacrylonitrile, polyvinyl acetate, polyvinyl alcohol, polyvinyl butyral, polyvinyl chloride, polyvinylcarbazole, polyvinyl ether, and polyvinyl ketone; a vinyl chloride-vinyl acetate copolymer; a styrene-acrylic acid copolymer; a straight-chain silicone resin composed of an organosiloxane bond or modified products thereof; fluorine-based resins such as polytetrafluoroethylene, polyvinyl fluoride, polyvinylidene fluoride, and polychlorotrifluoroethylene; silicone resins; polyesters; polyurethanes; polycarbonates; phenol resins; amino resins such as a urea-formaldehyde resin, a melamine resin, a benzoguanamine resin, a urea resin, and a polyamide resin; and epoxy resins. These resins may be used singly or in combinations of two or more kinds thereof. In the present exemplary embodiment, among these resins, it is preferable to use at least a fluorine-based resin and/or a silicone resin. The use of at least a fluorine-based resin and/or a silicone resin as the resin is beneficial in view of the fact that the effect of preventing carrier contamination (impaction) due to the toner or external additive is high.

As for the coating film made of the resin, it is preferable that a resin particle and/or a conductive particle be dispersed in the resin. Examples of the resin particles include a thermoplastic resin particle and a thermosetting resin particle. Among these, a thermosetting resin is preferable from the viewpoint that it is relatively easy to increase the hardness, and a resin particle composed of a nitrogen-containing resin containing N atoms is preferable from the viewpoint of imparting negative chargeability to the toner. These resin particles may be used singly or in combinations of two or more kinds thereof. An average particle diameter of the resin particles is preferably from 0.1 μm to 2 μm, and more preferably from 0.2 μm to 1 μm. When the average particle diameter of the resin particles is equal to or more than 0.1 μm, the dispersibility of the resin particles in the coating film is excellent, whereas when the average particle diameter of the resin particles is equal to or less than 2 μm, dropping of the resin particles from the coating film hardly occurs.

Examples of the conductive particle include metal particles of gold, silver, copper and the like; carbon black particles; and particles obtained by coating the surface of a powder of titanium oxide, zinc oxide, barium sulfate, aluminum borate, potassium titanate, or the like with tin oxide, carbon black, a metal or the like. These materials may be used singly or in combinations of two or more kinds thereof. Among these, carbon black particles are preferable in view of the fact that manufacturing stability, costs, conductivity, and the like are favorable. The kind of carbon black is not particularly limited, but carbon black having a DBP oil absorption of from 50 ml/100 g to 250 ml/100 g is preferred because of its excellent manufacturing stability. The coating amount of each of the resin, the resin particle and the conductive particle on the core material surface is preferably from 0.5% by weight to 5.0% by weight, and more preferably from 0.7% by weight to 3.0% by weight.

A method for forming the coating film is not particularly limited, but examples thereof include a method using a coating film forming solution in which the resin particles such as crosslinking resin particles and/or conductive particles, and the resin such as a styrene-acrylic resin, a fluorine-based resin and a silicone resin as a matrix resin are contained in a solvent.

Specific examples thereof include a dipping method of dipping the carrier core material in the coating film forming solution; a spray method of spraying the coating film forming solution onto the surface of the carrier core material; and a kneader coater method of mixing the coating film forming solution and the carrier core material in a state where it is floated by flowing air and removing the solvent. Among these, the kneader coater method is preferred in the present exemplary embodiment.

The solvent used in the coating film forming solution is not particularly limited so far as it is capable of dissolving only the resin that is a matrix resin. The solvent is chosen from known solvents, and examples thereof include aromatic hydrocarbons such as toluene and xylene, ketones such as acetone and methyl ethyl ketone, and ethers such as tetrahydrofuran and dioxane. In the case where the resin particles are dispersed in the coating film, since the resin particles and the particles as a matrix resin are uniformly dispersed in the thickness direction thereof and in the tangential direction to the carrier surface, even when the carrier is used for a long period of time, and the coating film is abraded, the surface formation which is similar to that of unused ones can be always kept, and a favorable ability of applying electrification to the toner can be kept over a long period of time. Also, in the case where the conductive particles are dispersed in the coating film, since the conductive particles and the resin as a matrix resin are uniformly dispersed in the thickness direction thereof and in a tangential direction to the carrier surface, even when the carrier is used for a long period of time, and the coating film is abraded, the surface formation which is similar to that of unused ones can be always kept, and deterioration of the carrier can be prevented over a long period of time. In the case where the resin particles and the conductive particles are dispersed in the coating film, the above-described effects can be exhibited at the same time.

The electrical resistance of the whole of the thus formed magnetic carrier in a magnetic brush state in an electric field of $10^4$ V/cm is preferably from $10^8$ Ωcm to $10^{13}$ Ωcm. When the electrical resistance of the magnetic carrier is equal to or more than $10^8$ Ωcm, adhesion of the carrier to an image area on the image holding member is suppressed, and a brush mark is hardly generated. On the other hand, when the electrical resistance of the magnetic carrier is equal to or less than $10^{13}$ Ωcm, the generation of an edge effect is suppressed, and a favorable image quality is obtainable.

The volume resistivity is measured as follows.

A sample is placed on a lower grid of a measuring jig that is a pair of 20-$cm^2$ circular grids (made of steel) connected to an electrometer (trade name: KEITHLEY 610C, manufactured by Keithley Instruments Inc.) and a high-voltage power supply (trade name: FLUKE 415B, manufactured by Fluke Corporation), so as to form a flat layer having a thickness of from about 1 mm to 3 mm. Subsequently, after the upper grid is placed on the sample, in order to make a sample-to-sample space free, a weight of 4 kg is placed on the upper grid. A thickness of the sample layer is measured in this state. Subsequently, by applying a voltage to the both grids, a current value is measured, and a volume resistivity is calculated according to the following formula.

Volume resistivity=Applied voltage×20÷(Current value-Initial current value)÷Sample Thickness In the formula, the initial current value is a current value when the applied voltage is 0, and the current value is a measured current value.

As for a mixing proportion of the toner to the carrier in the electrostatic charge image developer of a two-component system, the amount of the toner is preferably from 2 parts by weight to 10 parts by weight based on 100 parts by weight of the carrier. Further, a method for preparing the developer is not particularly limited, but examples thereof include a method of mixing by a V-blender or the like.

(Image Forming Method)

For the image forming method of the present exemplary embodiment, the transparent toner of the present exemplary embodiment and the color toner are used, when the volume average particle diameter of the color toner is denoted as Dc and the volume average particle diameter of the transparent toner is denoted as Dt, 3 μm≤Dc≤8 μm, 18 μm≤Dt≤28 μm, and 3≤Dt/Dc≤8 are satisfied, and in the shape factor distribution of the color toner, the proportion of particles having a circularity of from 0.7 to 0.9 is zero or equal to or less than 0.5% by number.

Also, the transparent toner of the present exemplary embodiment and the toner set of the present exemplary embodiment are suitably used for an image forming method of an electrostatic charge image development system (electrophotographic system).

Furthermore, the image forming method of the present exemplary embodiment is particularly suitably used as a thick printing method.

The transparent toner in the image forming method of the present exemplary embodiment is the same as the transparent toner of the present exemplary embodiment described above, and its preferred exemplary embodiment is also the same. Further, the color toner in the image forming method of the present exemplary embodiment is the color toner in the toner set of the present exemplary embodiment described above, and its preferred exemplary embodiment is also the same.

<Thick Printing Process>

The image forming method of the present exemplary embodiment preferably includes a step in which a transparent resin layer is formed by the transparent toner of the present exemplary embodiment on at least a part of the color image formed by the color toner to carry out thick printing (hereinafter also referred to as a "thick printing process").

The transparent toner of the present exemplary embodiment is a toner having a volume average particle diameter of from 18 μm to 28 μm and having a large particle diameter, and it is easy to carry out thick printing with a thick transparent resin layer on the color image.

In the thick printing process, the transparent resin layer formed by the transparent toner may be formed on at least a part of the color image formed by the color toner as well as may be formed throughout the color image. However, if desired, the transparent resin layer is preferably formed on apart intended to give a strong visual impression in the color image.

The thickness of the transparent resin layer in the thick printing process is preferably from 18 μm to 200 μm, and more preferably from 20 μm to 100 μm.

The color image in the thick printing process may be the color toner layer before fixing or the color image after fixing, but the thick printing process is preferably a step in which the transparent toner layer is formed by the transparent toner of the present exemplary embodiment on at least a part of the color toner image formed by the color toner, and fixed to carry out thick printing.

The fixing unit in the thick printing process is not particularly limited, and known fixing units may be used, but a heating fixing unit is preferred, and a fixing step of allowing the recording medium having the unfixed toner image formed thereon to pass between a heating member and a pressurizing member to fix the toner image is more preferred.

Moreover, the image forming method of the present exemplary embodiment preferably includes forming an electrostatic latent image on the surface of an image holding member, developing the electrostatic latent image formed on the surface of the image holding member by a developer containing a color toner to form a toner image, and transferring the toner image onto the surface of the transfer member to form a color image.

The respective steps in the image forming method of the present exemplary embodiment are general steps themselves, and are disclosed in, for example, JP-A-56-40868 and JP-A-49-91231. Further, the image forming method of the present exemplary embodiment can be implemented using a known image forming apparatus, such as a copying machine and a facsimile.

The charging step is a step of charging the image holding member.

The latent image forming step is a step of forming an electrostatic latent image on the surface of the image holding member.

The developing step is a step of developing the electrostatic latent image formed on the surface of the image holding member by the electrostatic charge image developing toner of the present exemplary embodiment or the electrostatic charge image developer including the electrostatic charge image developing toner of the present exemplary embodiment to form a toner image.

The transfer step is a step of transferring the toner image onto a transfer member.

The image forming apparatus used in the present exemplary embodiment is not particularly limited, a known image forming apparatus may be used, but it preferably includes an image holding member, a charging unit for charging the image holding member, an exposure unit for exposing the charged image holding member to form an electrostatic latent image on the surface of the image holding member, a developing unit for developing the electrostatic latent image by a developer including a toner to form a toner image, a transfer unit for transferring the toner image from the image holding member to the surface of the transfer member, and a fixing unit for fixing the toner image transferred onto the surface of the transfer member.

For the image holding member and the respective units, the constitution described in each step in the image forming method is preferably used.

As each of the units, any of units known in the image forming apparatus is utilized. Further, the image forming apparatus used in the present exemplary embodiment may include units, apparatus, and the like having a constitution other than the above-described constitution. In addition, in the image forming apparatus used in the present exemplary embodiment, two or more of the above-described units may be used at the same time.

(Toner Cartridge and Process Cartridge)

The toner cartridge of the present exemplary embodiment is a cartridge storing at least the transparent toner of the present exemplary embodiment therein. The toner cartridge of the present exemplary embodiment may be equipped with the transparent toner of the present exemplary embodiment as an electrostatic charge image developer.

Furthermore, the process cartridge of the present exemplary embodiment is a process cartridge, which includes at least one selected from the group consisting of a developing unit for developing the electrostatic latent image formed on the surface of the image holding member by the transparent toner or the electrostatic charge image developer to form a toner image, an image holding member, a charging unit for charging the surface of the image holding member, and a cleaning unit for removing the toner remaining on the surface of the image holding member, and which stores at least the electrostatic charge image developing toner of the present exemplary embodiment or the electrostatic charge image developer of the present exemplary embodiment therein.

The toner cartridge of the present exemplary embodiment is preferably attachable to or detachable from an image forming apparatus. That is, the toner cartridge of the present exemplary embodiment storing the transparent toner of the present exemplary embodiment therein is preferably used in the image forming apparatus which is configured to have the toner cartridge attachable thereto or detachable therefrom.

Furthermore, the toner cartridge may have a constitution that a cartridge stores a toner and a carrier therein, or that a cartridge storing a toner alone therein, and a cartridge storing a carrier alone therein are separate cartridges.

The process cartridge of the present exemplary embodiment is preferably attachable to or detachable from an image forming apparatus.

Furthermore, the process cartridge of the present exemplary embodiment may contain other members such as a charge erasing unit, if desired.

The toner cartridge and the process cartridge may have known constitutions and are referred to, for example, JP-A-2008-209489 and JP-A-2008-233736.

EXAMPLES

Hereinbelow, the present exemplary embodiment will be described in detail with reference to Examples, but is not construed to be limited thereto. Further, in the following description, "parts" and "%" mean "part(s) by weight" and "% by weight", respectively, unless otherwise indicated.

<Method for Measuring Glass Transition Temperature and Melting Temperature>

The glass transition temperature and the melting temperature are measured by means of differential scanning calorimetry (DSC) as defined in ASTM D3418-8. The measurement is carried out as follows.

That is, a material to be measured is first placed in a differential scanning calorimeter (device name: DSC-50 Type) manufactured by Shimadzu Corporation, equipped with an automatic tangent-line-processing system, liquid nitrogen as a cooling medium is set therein, and the material is heated from 0° C. to 150° C. at a heating rate of 10° C./min (first heating process), thereby determining the relationship between the temperature (° C.) and the quantity of heat (mW). Then, the material is cooled to 0° C. at a cooling rate of −10° C./min and then reheated up to 150° C. at a heating rate of 10° C./min (second heating process), thereby giving data. Further, the material is held at 0° C. and 150° C., respectively, for 10 minutes.

The melting temperature of a mixture of indium and zinc is used for the temperature calibration of the detecting portion of the measurement device, and the heat of fusion of indium is used for the calibration of the quantity of heat. A sample is put into an aluminum pan, and the aluminum pan having the sample therein and an empty aluminum pan as a control are set, respectively.

As for the glass transition temperature of the toner, a temperature at the intersection of the base line in the endothermic area and the extended line with the start line in the DSC curve obtained in the first heating process is taken as a glass transition temperature.

As for the glass transition temperature of the amorphous resin, a temperature at the intersection of the base line in the endothermic area and the extended line with the start line in the DSC curve obtained in the second heating process is taken as a glass transition temperature.

As for the melting point of the crystalline resin, a maximum peak temperature among the peaks having an endothermic quantity equal to or more than 25 J/g in the DSC curve obtained in the second heating process is taken as a melting point.

<Measurement of Weight Average Molecular Weight (Mw), Number Average Molecular Weight (Mn), and Peak Molecular Weight (MP)>

For the weight average molecular weight (Mw), the number average molecular weight (Mn), and the peak molecular weight (Mp) of the polyester resin (in terms of polystyrene, respectively), devices of HLC-8120 GPC and SC-8020 manufactured by Tosoh Corporation are used as a GPC device; TSKgel and SuperHM-H (6.0 mm ID×15 cm×2) are used as columns; and THF (tetrahydrofuran) for chromatography, manufactured by Wako Pure Chemical Industries, is used as an eluent. The experimental conditions are as follows: a sample concentration of 0.5%, a flow rate of 0.6 ml/min, a sample injection amount of 10 μl, and a measurement temperature of 40° C. A calibration curve is prepared from 10 samples, A-500, F-1, F-10, F-80, F-380, A-2500, F-4, F-40, F-128, and F-700. Further, the data collection interval in the analysis of samples is 300 ms.

<Measurement of Acid Value>

The acid value A is measured by a neutralization titration method in accordance with JIS K0070. That is, an appropriate amount of a sample is prepared and 160 ml of a solvent (acetone/toluene mixed liquid) and a few droplets of an indicator (phenolphthalein solution) are added thereto, and the mixture is shaken thoroughly and mixed until the sample is completely dissolved in the water bath. This is titrated with a 0.1 mol/l potassium hydroxide solution in ethanol and an endpoint is defined as a time point when the pale red color of the indicator remains for 30 seconds.

When the acid value is denoted as A, the amount of a sample is denoted as S (g), the amount of the 0.1-mol/l potassium hydroxide solution in ethanol, that is used in the titration, is denoted as B (ml), and f is defined as a factor for the 0.1-mol/l potassium hydroxide solution in ethanol, the acid value is calculated from the formula: $A=(B\times f\times 5.611)/S$.

<Method for Measuring Flow Tester ½ Descending Temperature>

When the descending amount of a plunger is plotted using a flow tester (CFT-500C, manufactured by Shimadzu Corporation) and measurement is carried out under the conditions of a sample amount of 1.05 g, a sample diameter of 1 mm, a preheating condition of 65° C. and 300 sec, a load of 10 kg, a die size with a diameter of 0.5 mm, and a heating rate of 1.0° C./min, a temperature at which a half of the sample flows out is defined as a ½ descending temperature.

<Method for Measuring Particle Diameter/Particle Diameter Distribution>

The volume average particle diameter of the toner particles is measured using a Multisizer II (manufactured by Beckmann Coulter, Inc.). As an electrolytic solution, ISOTON-II (manufactured by Beckman Coulter, Inc.) is used.

A cumulative distribution is drawn with respect to the volume and the number from the side of the smallest diameter against the partitioned particle size range (channel) on the basis of the particle size distribution thus measured. The particle diameter at a cumulative point of 16% with respect to the volume is defined as $D_{16v}$, the particle diameter at a cumulative point of 16% with respect to the number is defined as $D_{16p}$; the particle diameter at a cumulative point of 50% with respect to the volume is defined as $D_{50v}$, the particle diameter at a cumulative point of 50% with respect to the number is defined as $D_{50p}$; and the particle diameter at a cumulative point of 84% with respect to the volume is defined as $D_{84v}$, and the particle diameter at a cumulative point of 84% with respect to the number is defined as $D_{84p}$.

Using these measured values, the volume average particle size distribution index (GSDv) is calculated from the formula $\sqrt{(D_{84v}/D_{16v})}$, the number average particle size distribution index (GSDp) is calculated from the formula $\sqrt{(D_{84P}/D_{16P})}$, and the lower number average particle size distribution index (lower GSDp) is calculated from the formula $\sqrt{(D_{50p}/D_{16p})}$. The particle diameter in the present exemplary embodiment refers to $D_{50v}$ and GSDP refers to the lower number average particle size distribution index (lower GSDp).

<Calculation of Shape Factor SF1>

The shape factor of the color toner is measured using an FPIA-3000 (manufactured by Sysmex Corp.). The toner dispersion for measurement is prepared as follows. First, 30 ml of ion exchange water is put into a 100-ml beaker, and 0.1 g of a stock solution of surfactant (CONTAMINON, manufactured by Wako Pure Chemical Industries, Ltd.) as a dispersant are added dropwise thereto. 30 mg of a toner is added to the solution and dispersed therein by ultrasonic dispersion for 5 minutes to prepare a dispersion.

For the obtained toner dispersion, measurement is carried out for 4,500 particles using FPIA-3000 to calculate the shape factor.

The toner dispersion for measurement of the shape factor of the transparent toner is prepared as follows. First, 20 ml of ion exchange water is put into a 100-ml beaker, and 0.25 g of a stock solution of a surfactant (CONTAMINON, manufactured by Wako Pure Chemical Industries, Ltd.) as a dispersant is added dropwise thereto. 1.0 g of a toner is added to the solution and dispersed therein by ultrasonic dispersion for 5 minutes to prepare a dispersion. For the obtained toner dispersion, measurement is carried out using an FPIA-3000 in an HPF mode. The measurement data are analyzed again, and the average circle-equivalent diameter of the particles satisfying 0.5 μm≤circle-equivalent diameter≤200 μm and 0.40≤circularity≤1.00 is defined as Dta (μm), and the number of the limited particles is defined as Nta (number). Further, the same data are analyzed again, and with regard to the limitation conditions of the particles, the number of the limited particles satisfying 0.5×Dta (μm)≤circle-equivalent diameter≤2.5×Dta (μm) for the circle-equivalent diameter and 0.60≤circularity≤0.90 for the circularity is defined as Ntb. Further, the same data are analyzed again, and the number of the limited particles satisfying 2.5×Dta (μm)≤circle-equivalent diameter≤200 μm for the circle-equivalent diameter and 0.40≤circularity≤1.00 for the circularity is defined as Ntc.

<Method for Measuring Content of Sulfur>

Fluorescent X-ray analysis is carried out by quantitative analysis under the measurement conditions of a tube voltage of 40 kV, a tube current of 70 mA, a measurement time of 15 minutes, and a measurement area of a diameter of 10 mm (a sample in an amount of 0.3 g is shaped into a cylinder with a diameter of 10 mm), using an XRF-1500 (manufactured by Shimadzu Corporation) as a measurement device.

<Preparation of Colorant Dispersion (PDK1)>

Carbon Black (REAGAL 330, manufactured by Cabot Japan Corporation): 200 parts by weight Anionic Surfactant (Neogen SC, manufactured by Dai-Ichi Kogyo Seiyaku Co., Ltd.): 33 parts by weight (active ingredients 60% by weight, 10% by weight with respect to the colorant)

Ion Exchange Water: 750 parts by weight

The components as described above are put into a stainless steel container, which has a capacity such that the height of the liquid level is about ⅓ of the height of the container when all the components as described above are put into, and 280 parts by weight of ion exchange water and an anionic surfactant are put and the surfactant is thoroughly dissolved therein. Then, all the pigments as described above are put thereinto, the mixture is sufficiently stirred until no dry pigments remain using a stirrer, the remaining ion exchange water is added thereto, and the mixture is further stirred for sufficient defoaming.

After defoaming, the mixture is dispersed at 5,000 rpm for 10 minutes using a homogenizer (ULTRA TURRAX T50, manufactured by IKA), and then stirred with a stirrer for a whole day and night for defoaming. After defoaming, the mixture is again dispersed using a homogenizer at 6,000 rpm for 10 minutes, and then stirred with a stirrer for a whole day and night for defoaming.

After defoaming, the mixture is dispersed with a high pressure impact-type disperser Altimizer (HJP30006, manufactured by Sugino Machine Limited) at a pressure of 240 MPa. Dispersion is performed 25 pass equivalent from the total injection amount and the processing capacity of the device.

The obtained dispersion is left to stand for 72 hours and the precipitates are removed. Ion exchange water is added thereto to adjust the solid content concentration to 15% by weight thereby obtaining a colorant dispersion. The volume average particle diameter $D_{50v}$ of the particles in the colorant dispersion is 110 nm. Further, as the volume average particle diameter $D_{50v}$, an average value of the values as measured 5 times with Microtrack, excluding the maximum value and the minimum value, that is, the average value of the values as measured 3 times, is used.

<Preparation of Release Agent Dispersion (DW1)>

Hydrocarbon-based wax (manufactured by Nippon Seiro Co., Ltd., trade name: FNP0090, melting temperature Tw=90.2° C.): 270 parts by weight Anionic Surfactant (Tayca Power BN2060, manufactured by Tayca Corporation, amount of active ingredients: 60% by weight): 13.5 parts by weight (3.0% by weight with respective to the release agent, as the active ingredient)

Ion exchange water: 700 parts by weight

The above components are mixed, a release agent is dissolved therein with a pressure-ejecting-type homogenizer (manufactured by Manton Gaulin, Gaulin homogenizer) at an internal liquid temperature of 120° C., subjected to a dispersion treatment at a dispersion pressure of 5 MPa for 120 minutes and then at 40 MPa for 360 minutes, and cooled to obtain a release agent dispersion (W1). The volume average particle diameter $D_{50v}$ of the particles in the release agent dispersion is 220 nm. Thereafter, ion exchange water is added to adjust the solid content concentration to 20.0% by weight.

<Synthesis of Amorphous Polyester Resin (PES-A1)>

According to the composition in Table 1, monomers, exclusive of dodecenylsuccinic acid, are put into a reaction vessel equipped with a stirrer, a thermometer, a condenser, and a nitrogen gas-introducing pipe, and the inside of the reaction vessel is replaced with dry nitrogen gas. Then, tin dioctanoate is put thereinto in an amount of 0.3% by weight with respect to the total amount of the monomer components. The mixture is reacted while stirring under a nitrogen gas flow at about 180° C. for about 6 hours, and the temperature is then raised to about 235° C. over 1 hour. The mixture is reacted for about 3 hours, the temperature is then lowered to 220° C., the pressure within the reaction vessel is reduced to 10.0 mmHg, and the mixture is reacted under stirring for about 1 hour. After returning to normal pressure, dodecenysuccinic acid in Table 1 is added thereto, the mixture is reacted, and the reaction is completed when a desired molecular weight is obtained. The physical properties of the obtained amorphous polyester resin are shown in Table 1.

<Synthesis of Amorphous Polyester Resin (PES-A2)>

According to the composition in Table 1, monomers, exclusive of dodecenysuccinic acid and trimellitic anhydride, are put into a reaction vessel equipped with a stirrer, a thermometer, a condenser, and a nitrogen gas-introducing pipe, and the inside of the reaction vessel is replaced with dry nitrogen gas. Then, tin dioctanoate is put thereinto in an amount of 0.3% by weight with respect to the total amount of the monomer components. The mixture is reacted while stirring under a nitrogen gas flow at about 180° C. for about 6 hours, and the temperature is then raised to about 235° C. over 1 hour. The mixture is reacted for about 3 hours, the temperature is then lowered to 220° C., the pressure within the reaction vessel is reduced to 10.0 mmHg, and the mixture is reacted while stirring for about 1 hour. After returning to normal pressure, dodecenysuccinic acid in Table 1 is added thereto, the mixture is reacted for about 2 hours, trimellitic anhydride is then added thereto, the mixture is further reacted, and the reaction is completed when a desired molecular weight is obtained. The physical properties of the obtained amorphous polyester resin are shown in Table 1.

<Synthesis of Crystalline Polyester Resin (PES-C1)>

According to the composition in Table 1, monomers are put into a reaction vessel equipped with a stirrer, a thermometer, a condenser, and a nitrogen gas-introducing pipe, and the inside of the reaction vessel is replaced with dry nitrogen gas. Then, titanium tetrabutoxide (reagent) is put thereinto in an amount of 0.3% by weight with respect to 100 parts by weight of the monomer components. The mixture is reacted while stirring under a nitrogen gas flow at 170° C. for 3 hours, and the temperature is then raised to 210° C. over 1 hour. The pressure within the reaction vessel is reduced to 3 kPa and the reaction is completed when a desired molecular weight is obtained. The physical properties of the obtained crystalline polyester resin are shown in Table 1.

<Preparation of Amorphous Polyester Resin Particle Dispersion (DA-A1)>

A mixed solvent of 180 parts by weight of ethyl acetate and 80 parts by weight of isopropyl alcohol is put into a reaction bath (BJ-30N, manufactured by Tokyo Rikakikai Co., Ltd.) equipped with a condenser, a thermometer, a water dripping funnel, and a jacket with an anchor blade, which is maintained at 40° C. with a water-circulating constant temperature bath. Further, 300 parts by weight of the above amorphous polyester resin (PES-A1) is put therein, and the mixture is stirred with a three-one motor at 150 rpm and dissolved to obtain an oil phase. A mixed liquid of 1 part by weight of a 10%-by-weight aqueous ammonia solution and 47 parts by weight of a 5%-by-weight aqueous sodium hydroxide solution is added dropwise over 5 minutes to this oil phase being stirred, and mixed for 10 minutes. Then, 900 parts by weight of ion exchange water is further added dropwise thereto at a rate of 5 parts by weight per min for phase inversion to obtain an emulsion.

Immediately after that, 800 parts by weight of the obtained emulsion and 700 parts by weight of ion exchange water are put into an egg-plant-type flask, and the flask is attached to an evaporator (manufactured by Tokyo Rikakikai Co, Ltd.) equipped with a vacuum control unit via a trap ball. After heating the mixed liquid at 60° C. in a hot water bath while rotating the egg-plant-type flask, the pressure is reduced to 7 kPa while being careful not to cause abrupt boiling, and the solvent is removed. When the amount of the collected solvent reaches 1,100 parts by weight, the pressure is returned to normal pressure, and the egg-plant-type flask is cooled with water to obtain a dispersion. There is no solvent odor in the obtained dispersion. The volume average particle diameter $D_{50v}$ of the resin particles in the dispersion is 130 nm. Thereafter, the solid content concentration is adjusted to 20% by weight by the addition of ion exchange water. The product thus obtained is taken as an amorphous polyester resin particle dispersion (DA-A1).

<Preparation of Amorphous Polyester Resin Particle Dispersion (DA-A2)>

By the same procedure as in the preparation of the amorphous polyester resin particle dispersion (DA-A1), except that the amorphous polyester resin (PES-A1) is changed to an amorphous polyester resin (PES-A2), an amorphous polyester resin particle dispersion (DA-A2) is obtained. The volume average particle diameter $D_{50v}$ of the resin particles in the dispersion is 100 nm.

<Preparation of Crystalline Polyester Resin Particle Dispersion (DA-C1)>

300 parts by weight of the crystalline polyester resin (PES-C1), 160 parts by weight of methyl ethyl ketone (solvent), and 100 parts by weight of isopropyl alcohol (solvent) are put into a reaction bath (BJ-30N, manufactured by Tokyo Rikakikai Co., Ltd.) equipped with a condenser, a thermometer, a water dripping funnel, and a jacket with an anchor blade, which is maintained at 70° C. with a water-circulating constant temperature bath, and the resin is dissolved while mixing and stirring at 100 rpm.

Then, the stirring rotation rate is set at 150 rpm and the water-circulating constant temperature bath is set at 66° C. 15 parts by weight of a 10%-by-weight aqueous ammonia solution is added dropwise thereto over 5 minutes, and mixed for 10 minutes, and then 900 parts by weight of ion exchange water that has been kept warm at 66° C. is further added dropwise thereto at a rate of 5 parts by weight per min for phase inversion to obtain an emulsion.

Immediately after that, 800 parts by weight of the obtained emulsion and 700 parts by weight of ion exchange water are put into an egg-plant-type flask, and the flask is attached to an evaporator (manufactured by Tokyo Rikakikai Co, Ltd.) equipped with a vacuum control unit via a trap ball. After heating the mixed liquid at 60° C. in a hot water bath while rotating the egg-plant-type flask, the pressure is reduced to 7 kPa while being careful not to cause abrupt boiling, and the solvent is removed. When the amount of the collected solvent reaches 1,100 parts by weight, the pressure is returned to normal pressure, and the egg-plant-type flask is cooled with water to obtain a dispersion. There is no solvent odor in the obtained dispersion. The volume average particle diameter $D_{50v}$ of the resin particles in the dispersion is 130 nm. Thereafter, the solid content concentration is adjusted to 20% by weight by the addition of ion exchange water. The product thus obtained is taken as a crystalline polyester resin particle dispersion (DA-C1).

The details of the respective polyester resins are shown in Table 1 below.

TABLE 1

| | PES-A1 | PES-A2 | PES-C1 |
|---|---|---|---|
| Bisphenol A-propylene oxide adduct | 80.0 | 60.0 | — |
| Bisphenol A-ethylene oxide adduct | 20.0 | 40.0 | — |
| 1,9-Nonanediol | — | — | 100.0 |
| Terephthalic acid | 70.0 | 58.0 | — |
| Cyclohexanedicarboxylic acid | 5.0 | — | — |
| Fumaric acid | 5.0 | — | — |
| Trimellitic anhydride | — | 7.0 | — |
| Dodecenysuccinic acid | 20.0 | 35.0 | — |
| Dodecanedioic acid | — | — | 100.0 |
| Total amount (parts) | 200.0 | 200.0 | 200.0 |
| Glass transition temperature [° C.] | 56.0 | 57.0 | — |
| Melting temperature [° C.] | — | — | 74.0 |
| Mw | 17,000 | 95,000 | 26,000 |
| Mn | 6,000 | 8,200 | 11,000 |
| Mp | 14,000 | 16,000 | 26,000 |
| Acid value [mg KOH/g] | 11.5 | 13.0 | 10.0 |
| Flow tester ½ descending temperature [° C.] | 103.0 | 120.0 | — |

Example 1

Production of Transparent Toner (TNA1T-1)

<Preparation of Additional Amorphous Polyester Resin Particle Dispersion (DA-A1T-1)>

Amorphous polyester resin dispersion (DA-A1): 160 parts by weight

Amorphous polyester resin dispersion (DA-A2): 160 parts by weight

Dowfax2A-1 (sodium alkyldiphenyloxide disulfonate, manufactured by Dow Chemical Co.): 1.25 parts by weight The above components are put into a beaker, and the pH is adjusted to 4.0 using 1.0%-by-weight aqueous nitric acid solution while stirring the mixture with a magnetic stirrer at a speed not entraining bubbles therein, thereby obtaining an additional amorphous polyester resin particle dispersion (DA-A1T-1).

<Preparation of Aqueous Aluminum Sulfate Solution (SA1T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight Ion exchange water: 15 parts by weight The above components are put into a vessel and mixed with stirring until the precipitates disappear at 30° C., thereby preparing an aqueous aluminum sulfate solution.

<Preparation of Transparent Toner (TNA1T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 1.50 parts by weight

Anionic surfactant (Tayca Power BN2060, manufactured by Tayca Corporation, amount of active ingredients: 60% by weight): 1.58 parts by weight Ion Exchange Water: 650 parts by weight The above components are put into a reaction vessel equipped with a thermometer, a pH meter, and a stirrer, and stirred while avoiding the occurrence of a vortex. The pH is adjusted to 4.5 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA1T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 55° C. at a heating rate of 1.0° C./min and kept at 55° C. The particle diameters are measured every 10 minutes with a Multisizer and when the volume average particle diameter reaches 20.0 μm, the entire additional amorphous polyester resin dispersion (DA-A1T-1) is further added over 30 minutes and then the resultant is kept as it is for 15 minutes.

After putting the additional amorphous polyester resin dispersion (DA-A1T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

After cooling, the slurry is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA1T-1). When the SEM image of the toner is observed, it is found that the toner has a smooth surface and there is no problem of, for example, protrusion of the release agent and detachment of the surface layers.

<Production of Transparent Toner (TNA1T-2)>

<Preparation of Additional Amorphous Polyester Resin Particle Dispersion (DA-A1T-2)>

Amorphous polyester resin dispersion (DA-A1): 160 parts by weight

Amorphous polyester resin dispersion (DA-A2): 160 parts by weight

Dowfax2A-1: 1.25 parts by weight

The above components are put into a beaker, and the pH is adjusted to 4.0 using 1.0%-by-weight aqueous nitric acid solution while stirring the mixture with a magnetic stirrer at a speed not entraining bubbles therein, thereby obtaining an additional amorphous polyester resin particle dispersion (DA-A1T-2).

<Preparation of Aqueous Aluminum Sulfate Solution (SA1T-2)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.43 parts by weight Ion exchange water: 20 parts by weight The above components are put into a vessel and mixed with stirring until the precipitates disappear at 30° C., thereby preparing an aqueous aluminum sulfate solution.

<Preparation of Transparent Toner (TNA1T-2)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 1.80 parts by weight

Anionic Surfactant (Tayca Power BN2060, manufactured by Tayca Corporation, amount of active ingredients: 60% by weight): 1.58 parts by weight Ion Exchange Water: 530 parts by weight The above components are put into a reaction vessel equipped with a thermometer, a pH meter, and a stirrer, and stirred while avoiding the occurrence of a vortex. The pH is adjusted to 4.5 by the addition of 1.0%-by-weight nitric acid at a temperature of 25° C. Then, while dispersing with a homogenizer (ULTRA TURRAX T50, manufactured by TKA, Japan) at 3,000 rpm, the entire amount of the prepared aqueous aluminum sulfate solution (SA1T-2) is added thereto and dispersed for 6 minutes.

Thereafter, a mantle heater is installed for the reaction vessel, and while adjusting the rotation rate of the stirrer such that the slurry is kept stirred sufficiently, the temperature is raised to 48° C. at a heating rate of 0.5° C./min, and after reaching 48° C., the temperature is raised at a heating rate of 0.02° C./min. The particle diameters are measured every 10 minutes with a Multisizer and when the volume average particle diameter reaches 15.0 μm, the entire additional amorphous polyester resin dispersion (DA-A1T-2) is further added over 30 minutes and then the resultant is kept for 15 minutes.

After putting the additional amorphous polyester resin dispersion (DA-A1T-2) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is adjusted to 8.0 using a 1.0%-by-weight aqueous nitric acid solution, the shape factor is measured with an FPIA-3000 (manufactured by Sysmex Corp.) every 10 minutes, and the vessel is cooled to 30° C. over 5 minutes with cooling water when the average shape factor reaches 0.960.

The slurry after cooling is passed through a nylon mesh with a pore size of 70 μm, the coarse powder is removed, and further, the product is passed through a nylon mesh with a pore size of 20 μm, and the toner slurry remaining on the mesh is collected. The collected toner slurry is put into 1 liter of ion exchange water at a temperature of 30° C. and mixed with stirring for 30 minutes, and again subjected to solid-liquid separation with an aspirator. This operation is repeated until the electrical conductivity of the filtrate is equal to or less than 5 μS/cm, and the toner is washed.

The washed toner is finely pulverized with a wet-type/dry-type granulating machine (Comil), and dried by vacuum drying in an oven at 35° C. for 36 hours to obtain toner particles (TNA1T-2). When the SEM image of the toner is observed, there is no problem of, for example, protrusion of the release agent and detachment of the surface layers, but a little irregular shape with the coalesced particles having a size of about 10 μm is seen. For this toner, the particle diameter is 28.8 μm and the shape factor as measured by FPIA-3000 is 0.853.

<Preparation of Transparent Toner (TNA1T)>

97.5 parts by weight of the obtained transparent toner (TNA1T-1) and 2.5 parts by weight of the transparent toner (TNA1T-2) are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA1T). The physical properties of the obtained toner are shown in Table 2.

<Preparation of Resin-Coated Carrier (C-1)>

Mn—Mg—Sr-Based Ferrite Particles (average particle diameter 100 μm): 100 parts by weight Toluene: 14 parts by weight Cyclohexyl methacrylate/dimethylaminoethyl methacrylate copolymer (copolymerization weight ratio 99:1, Mw 80,000): 0.6 part by weight Carbon Black (VXC72: manufactured by Cabot Corporation): 0.03 part by weight The above components, exclusive of ferrite particles, and glass beads (4: 1 mm, the same amount with toluene) are stirred at 1,200 ppm for 30 minutes using a sand mill manufactured by Kansai Paint Co., Ltd. to obtain a solution for forming a resin-coated layer. The solution for forming a resin-coated layer and ferrite particles are put into a vacuum deaeration kneader and the pressure is reduced to evaporate toluene. The product is dried to prepare a resin-coated carrier (C-1).

<Preparation of Developer (DTNA1T)>

40 parts by weight of the toner (TNA1T) is added to 500 parts by weight of the resin-coated carrier (C-1), and the mixture is blended with a V-type blender for 20 minutes and then filtered through a vibrating screen having a pore size of 212 μm to remove the aggregates to prepare a developer (DTNA1T).

<Production of Color Toner (TNA1K)>

<Preparation of Additional Amorphous Polyester Resin Particle Dispersion (DA-A1A)>

Amorphous Polyester Resin Dispersion (DA-A1): 160 parts by weight

Amorphous Polyester Resin Dispersion (DA-A2): 160 parts by weight

Dowfax2A-1: 1.25 parts by weight

The above components are put into a beaker, and the pH is adjusted to 4.0 using 1.0%-by-weight aqueous nitric acid solution while stirring the mixture with a magnetic stirrer at a speed not entraining bubbles therein, thereby obtaining an additional amorphous polyester resin particle dispersion (DA-A1A).

<Preparation of Aqueous Aluminum Sulfate Solution (SA1A)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.25 parts by weight Ion exchange water: 20 parts by weight The above components are put into a vessel and mixed with stirring until the precipitates disappear at 30° C., thereby preparing an aqueous aluminum sulfate solution.

<Preparation of Color Toner (TNA1K)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 130 parts by weight

Colorant Dispersion (PDK1): 110 parts by weight

Dowfax2A-1: 3.0 parts by weight

Ion Exchange Water: 500 parts by weight

The above components are put into a reaction vessel equipped with a thermometer, a pH meter, and a stirrer, and stirred while avoiding the occurrence of a vortex. The pH is adjusted to 4.0 by the addition of 1.0%-by-weight nitric acid at a temperature of 25° C. Then, while dispersing with a homogenizer (ULTRA TURRAX T50, manufactured by IKA, Japan) at 6,000 rpm, the entire amount of the prepared aqueous aluminum sulfate solution (SA1A) is added thereto and dispersed for 6 minutes.

Thereafter, a mantle heater is installed for the reaction vessel, and while adjusting the rotation rate of the stirrer such that the slurry is kept stirred sufficiently, the temperature is raised to 43° C. at a heating rate of 1.0° C./min and kept at 43° C. The particle diameters are measured every 10 minutes with a Multisizer and when the volume average particle diameter reaches 5.0 μm, the entire additional amorphous polyester resin dispersion (DA-A1A) is further added over 30 minutes and then the resultant is kept as it is for 15 minutes.

After putting the additional amorphous polyester resin dispersion (DA-A1A) thereinto, 9 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 85° C. at a heating rate of 1° C./min and kept at 85° C. After the temperature reaches 85° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.964.

The slurry after cooling is passed through a nylon mesh with a pore size of 15 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles. With respect to 100 parts of weight of the obtained toner particles, 1.0 part by weight of hydrophobic titanium oxide (manufactured by Nippon Aerosil Co., Ltd., P25), 1.0 part by weight of hydrophobic silica (manufactured by Nippon Aerosil Co., Ltd., RX50), and 0.50 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 45 μm to obtain a toner (TNA1K).

The physical properties of the obtained toner are shown in Table 2. Further, when the SEM image of the toner is observed, it is found that the toner has a smooth surface and there is no problem of, for example, protrusion of the release agent and detachment of the surface layers.

<Preparation of Resin-Coated Carrier (0-2)>

Mn—Mg—Sr-Based Ferrite Particles (average particle diameter 40 μm): 100 parts by weight Toluene: 14 parts by weight Cyclohexyl methacrylate/dimethylaminoethyl methacrylate copolymer (copolymerization weight ratio 99:1, Mw 80,000): 2.0 parts by weight Carbon Black (VXC72: manufactured by Cabot Corporation): 0.12 part by weight The above components, exclusive of ferrite particles, and glass beads (φ: 1 mm, the same amount with toluene) are stirred at 1,200 ppm for 30 minutes using a sand mill manufactured by Kansai Paint Co., Ltd. to obtain a solution for forming a resin-coated layer. Further, the solution for forming a resin-coated layer and ferrite particles are put into a vacuum deaeration kneader and the pressure is reduced to evaporate toluene. The product is dried to prepare a resin-coated carrier (C-2).

<Preparation of Developer (DTNA1K)>

40 parts by weight of the toner (TNA1K) is added to 500 parts by weight of the resin-coated carrier (C-2), and the mixture is blended with a V-type blender for 20 minutes, and then filtered through a vibrating screen having a pore size of 212 μm to remove the aggregates to prepare a developer (DTNA1K).

<Evaluation of Image Sharpness>

With the combinations of the transparent toners and the color toners as shown in Table 2, the image sharpness is evaluated. In a room under an environment of a temperature of 25° C. and a humidity of 60%, a developing machine of DocuColor 1450GA manufactured by Fuji Xerox Co., Ltd., a toner cartridge, and the area around the toner supply accessories in the main member are thoroughly cleaned. Then, a transparent toner developer is put into a developing machine for yellow color and a transparent toner is put into a yellow cartridge, which are each set at the original position in the main member of a DocuColor 1450GA. Similarly, a color developer is put into a developing machine for magenta color and a color toner is put into a magenta toner cartridge, which are each set at the original position in the main member of the DocuColor 1450GA. The developing machine for black color, the black toner cartridge, and the developing machine for cyan color, and the cyan toner cartridge are used as they are.

Subsequently, in order to charge the developer, 20 sheets of A3 paper are passed through without developing. Next, using OK Top Coat Paper, the developing amount per sheet of the transparent toner and the developing amount per sheet of the color toner are adjusted to 25.0 g/m$^2$ and 4.0 g/m$^2$, respectively.

Next, a solid image having a size of 5×5 cm of the transparent toner is formed to be overlapped in the central part of a solid image having a size of 5×5 cm of the color toner, and coated paper with a paper weight of 300 g/m$^2$ is chosen and used. Fixing is carried out under the condition of Level 2 with adjustment of gloss to prepare a steric image.

Further, the sharpness of the image edge is evaluated by the method as follows.

After fixing, an image is scanned from a non-image portion to an image portion with a surface roughness meter (Surfcom, manufactured by Tokyo Seimitsu Co., Ltd.) to prepare a height profile (vertical magnification 500-fold and horizontal magnification 20-fold).

When the height of the non-image portion is taken as zero, a point at the image height of 3 μm is taken as X1, and a point at the image height of 22 μm is taken as X2, a smaller distance between X2 and X1 indicates a sharper edge. For one image, an average value of the three values as measured at five points, excluding the maximum value and the minimum value, is taken as a value.

Evaluation is carried out in accordance with the following evaluation criteria.

(Evaluation Criteria)

A: Equal to or less than 0.14 mm.

B: More than 0.14 mm and equal to or less than 0.18 mm.

C: More than 0.18 mm and equal to or less than 0.21 mm.

D: More than 0.21 mm.

The evaluation results are shown in Table 2.

Example 2

By the same method as in Example 1, except that the amount of the transparent toner (TNA1T-1) is changed to 98.6 parts by weight and the amount of the transparent toner (TNA1T-2) is changed to 1.4 parts by weight in the preparation of the transparent toner (TNA1T) of Example 1, a transparent toner (TNA2T) and a transparent toner developer (DTNA2T) are obtained. The physical properties of the obtained toner are shown in Table 2.

Example 3

By the same method as in Example 1, except that the amount of the transparent toner (TNA1T-1) is changed to 98.8 parts by weight and the amount of the transparent toner (TNA1T-2) is changed to 1.2 parts by weight in the preparation of the transparent toner (TNA1T) of Example 1, a transparent toner (TNA3T) and a transparent toner developer (DTNA3T) are obtained. The physical properties of the obtained toner are shown in Table 2.

Example 4

By the same method as in Example 1, except that the amount of the transparent toner (TNA1T-1) is changed to 99.1 parts by weight and the amount of the transparent toner (TNA1T-2) is changed to 0.9 part by weight in the preparation of the transparent toner (TNA1T) of Example 1, a transparent toner (TNA4T) and a transparent toner developer (DTNA4T) are obtained. The physical properties of the obtained toner are shown in Table 2.

Example 5

By the same method as in Example 1, except that the amount of the transparent toner (TNA1T-1) is changed to 99.3 parts by weight and the amount of the transparent toner (TNA1T-2) is changed to 0.7 part by weight in the preparation of the transparent toner (TNA1T) of Example 1, a transparent toner (TNA5T) and a transparent toner developer (DTNA5T) are obtained. The physical properties of the obtained toner are shown in Table 2.

Example 6

By the same method as in Example 1, except that the amount of the transparent toner (TNA1T-1) is changed to 99.5 parts by weight and the amount of the transparent toner (TNA1T-2) is changed to 0.5 part by weight in the preparation of the transparent toner (TNA1T) of Example 1, a transparent toner (TNA6T) and a transparent toner developer (DTNA6T) are obtained. The physical properties of the obtained toner are shown in Table 2.

Example 7

By the same method as in Example 1, except that the amount of the transparent toner (TNA1T-1) is changed to 99.9 parts by weight and the amount of the transparent toner (TNA1T-2) is changed to 0.1 part by weight in the preparation of the transparent toner (TNA1T) of Example 1, a transparent toner (TNA7T) and a transparent toner developer (DTNA7T) are obtained. The physical properties of the obtained toner are shown in Table 2.

Example 8

Production of Transparent Toner (TNA8T-1)

<Preparation of Additional Amorphous Polyester Resin Particle Dispersion (DA-A8T-1)>

Amorphous Polyester Resin Dispersion (DA-A1): 160 parts by weight

Amorphous Polyester Resin Dispersion (DA-A2): 160 parts by weight

Dowfax2A-1: 1.25 parts by weight

The above components are put into a beaker, and the pH is adjusted to 4.0 using 1.0%-by-weight aqueous nitric acid solution while stirring the mixture with a magnetic stirrer at a speed not entraining bubbles therein, thereby obtaining an additional amorphous polyester resin particle dispersion (DA-A8T-1).

<Preparation of Aqueous Aluminum Sulfate Solution (SA8T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight Ion exchange water: 15 parts by weight The above components are put into a vessel and mixed with stirring until the precipitates disappear at 30° C., thereby preparing an aqueous aluminum sulfate solution.

<Preparation of Transparent Toner (TNA8T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 1.50 parts by weight

Anionic Surfactant (Tayca Power BN2060, manufactured by Tayca Corporation, amount of active ingredients: 60% by weight): 1.00 part by weight Ion Exchange Water: 950 parts by weight The above components are put into a reaction vessel equipped with a thermometer, a pH meter, and a stirrer, and stirred while avoiding the occurrence of a vortex. The pH is adjusted to 4.5 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA8T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 55° C. at a heating rate of 1.0° C./min and then raised at a heating rate of 0.1° C./min. The particle diameters are measured every 10 minutes with a Multisizer and when the volume average particle diameter reaches 33.0 μm, the entire additional amorphous polyester resin dispersion (DA-A8T-1) is further added over 30 minutes and then the resultant is kept as it is for 15 minutes.

After putting the additional amorphous polyester resin dispersion (DA-A8T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.945.

The slurry after cooling is passed through a nylon mesh with a pore size of 106 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA8T-1). When the SEM image of the toner is observed, it is found that the toner has a smooth surface and there is no problem of, for example, protrusion of the release agent and detachment of the surface layers.

<Preparation of Transparent Toner (TNA8T)>

1.8 parts by weight of the obtained transparent toner (TNA8T-1), 97.5 parts by weight of the transparent toner (TNA1T-1) obtained in Example 1, and 1.7 parts by weight of the transparent toner (TNA1T-2) are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA8T). The physical properties of the obtained toner are shown in Table 2.

Example 9

By the same method as in Example 8, except that the amount of the transparent toner (TNA8T-1) is changed to 0.8 part by weight, the amount of the transparent toner (TNA1T-1) obtained in Example 1 is changed to 98.3 parts by weight, and the amount of the transparent toner (TNA1T-2) is changed to 0.9 part by weight in the preparation of the transparent toner (TNA8T) of Example 8, a toner (TNA9T) is obtained. The physical properties of the obtained toner are shown in Table 2.

Example 10

By the same method as in Example 8, except that the amount of the transparent toner (TNA8T-1) is changed to 0.5 part by weight, the amount of the transparent toner (TNA1T-1) obtained in Example 1 is changed to 98.7 parts by weight, and the amount of the transparent toner (TNA1T-2) is changed to 0.8 part by weight in the preparation of the transparent toner (TNA8T) of Example 8, a toner (TNA10T) is obtained. The physical properties of the obtained toner are shown in Table 2.

Example 11

By the same method as in Example 8, except that the amount of the transparent toner (TNA8T-1) is changed to 0.3 part by weight, the amount of the transparent toner (TNA1T-1) obtained in Example 1 is changed to 98.8 parts by weight, and the amount of the transparent toner (TNA1T-2) is changed to 0.9 part by weight in the preparation of the transparent toner (TNA8T) of Example 8, a toner (TNA11T) is obtained. The physical properties of the obtained toner are shown in Table 2.

Example 12

By the same method as in Example 8, except that the amount of the transparent toner (TNA8T-1) is changed to 0.2 part by weight, the amount of the transparent toner (TNA1T-1) obtained in Example 1 is changed to 98.9 parts by weight, and the amount of the transparent toner (TNA1T-2) is changed to 0.9 part by weight in the preparation of the transparent toner (TNA8T) of Example 8, a toner (TNA12T) is obtained. The physical properties of the obtained toner are shown in Table 2.

Example 13

Production of Transparent Toner (TNA13T-1)

<Preparation of Additional Amorphous Polyester Resin Particle Dispersion (DA-A13T-1)>

Amorphous Polyester Resin Dispersion (DA-A1): 160 parts by weight

Amorphous Polyester Resin Dispersion (DA-A2): 160 parts by weight

Dowfax2A-1: 1.25 parts by weight

The above components are put into a beaker, and the pH is adjusted to 4.0 using 1.0%-by-weight aqueous nitric acid solution while stirring the mixture with a magnetic stirrer at a speed not entraining bubbles therein, thereby obtaining an additional amorphous polyester resin particle dispersion (DA-A13T-1).

<Preparation of Aqueous Aluminum Sulfate Solution (SA13T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.17 parts by weight Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA13T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 1.80 parts by weight

Anionic Surfactant (Tayca Power BN2060, manufactured by Tayca Corporation, amount of active ingredients: 60% by weight): 1.58 parts by weight Ion Exchange Water: 1,450 parts by weight The above components are put into a reaction vessel equipped with a thermometer, a pH meter, and a stirrer, and stirred while avoiding the occurrence of a vortex. The pH is adjusted to 5.0 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA13T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 50° C. at a heating rate of 1.0° C./min and then raised at a heating rate of 0.03° C./min. The particle diameters are measured every 10 minutes with a Multisizer and when the volume average particle diameter reaches 20.0 μm, the entire additional amorphous polyester resin dispersion (DA-A13T-1) is further added over 30 minutes and then the resultant is kept as it is for 15 minutes.

After putting the additional amorphous polyester resin dispersion (DA-A13T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA13T-1). When the SEM image of the toner is observed, it is found that the toner has a smooth surface and there is no problem of, for example, protrusion of the release agent and detachment of the surface layers.

<Preparation of Transparent Toner (TNA13T)>

99.0 parts by weight of the obtained transparent toner (TNA13T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA13T). The physical properties of the obtained toner are shown in Table 2.

Example 14

Production of Transparent Toner (TNA14T-1)

<Preparation of Additional Amorphous Polyester Resin Particle Dispersion (DA-A14T-1)>

- Amorphous Polyester Resin Dispersion (DA-A1): 160 parts by weight
- Amorphous Polyester Resin Dispersion (DA-A2): 160 parts by weight
- Dowfax2A-1: 1.25 parts by weight The above components are put into a beaker, and the pH is adjusted to 4.0 using 1.0%-by-weight aqueous nitric acid solution while stirring the mixture with a magnetic stirrer at a speed not entraining bubbles therein, thereby obtaining an additional amorphous polyester resin particle dispersion (DA-A14T-1).

<Preparation of Aqueous Aluminum Sulfate Solution (SA14T-1)>

- Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight
- Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA14T-1)>

- Amorphous Polyester Resin Dispersion (DA-A1): 340 parts by weight
- Amorphous Polyester Resin Dispersion (DA-A2): 340 parts by weight
- Crystalline Polyester Resin Dispersion (DA-C1): 65 parts by weight
- Release Agent Dispersion (DW1): 195 parts by weight
- Dowfax2A-1: 1.80 parts by weight
- Anionic Surfactant (Tayca Power BN2060, manufactured by Tayca Corporation, amount of active ingredients: 60% by weight): 1.58 parts by weight
- Ion Exchange Water: 1,180 parts by weight The above components are put into a reaction vessel equipped with a thermometer, a pH meter, and a stirrer, and stirred while avoiding the occurrence of a vortex. The pH is adjusted to 4.8 by the addition of 1.0%-by-weight nitric acid at a temperature of 25° C. Then, while dispersing with homogenizer (ULTRA TURRAX T50, manufactured by IKA, Japan) at 5,000 rpm, the entire amount of the prepared aqueous aluminum sulfate solution (SA14T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 53° C. at a heating rate of 1.0° C./min and then raised at a heating rate of 0.03° C./min. The particle diameters are measured every 10 minutes with a Multisizer and when the volume average particle diameter reaches 20.0 μm, the entire additional amorphous polyester resin dispersion (DA-A14T-1) is further added over 30 minutes and then the resultant is kept as it is for 15 minutes.

After putting the additional amorphous polyester resin dispersion (DA-A14T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA14T-1). When the SEM image of the toner is observed, it is found that the toner has a smooth surface and there is no problem of, for example, protrusion of the release agent and detachment of the surface layers.

<Preparation of Transparent Toner (TNA14T)>

99.0 parts by weight of the obtained transparent toner (TNA14T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 to obtain a toner (TNA14T). The physical properties of the obtained toner are shown in Table 2.

Example 15

Production of Transparent Toner (TNA15T-1)

<Preparation of Additional Amorphous Polyester Resin Particle Dispersion (DA-A15T-1)>

Amorphous Polyester Resin Dispersion (DA-A1): 160 parts by weight

Amorphous Polyester Resin Dispersion (DA-A2): 160 parts by weight

Dowfax2A-1 (sodium alkyldiphenyloxide disulfonate, manufactured by The Dow Chemical Company): 1.25 parts by weight The above components are put into a beaker, and the pH is adjusted to 4.0 using 1.0%-by-weight aqueous nitric acid solution while stirring the mixture with a magnetic stirrer at a speed not entraining bubbles therein, thereby obtaining an additional amorphous polyester resin particle dispersion (DA-A15T-1).

<Preparation of Aqueous Aluminum Sulfate Solution (SA15T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA15T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 1.50 parts by weight

Anionic Surfactant (Tayca Power BN2060, manufactured by Tayca Corporation, amount of active ingredients: 60% by weight): 1.88 parts by weight Ion Exchange Water: 430 parts by weight The above components are put into a reaction vessel equipped with a thermometer, a pH meter, and a stirrer, and stirred while avoiding the occurrence of a vortex. The pH is adjusted to 3.8 by the addition of 1.0%-by-weight nitric acid at a temperature of 25° C. Then, while dispersing with a homogenizer (ULTRA TURRAX T50, manufactured by TKA, Japan) at 5,000 rpm, the entire amount of the prepared aqueous aluminum sulfate solution (SA15T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 53° C. at a heating rate of 1.0° C./min and then raised at a heating rate of 0.05° C./rain. The particle diameters are measured every 10 minutes with a Multisizer and when the volume average particle diameter reaches 20.0 μm, the entire additional amorphous polyester resin dispersion (DA-A15T-1) is further added over 30 minutes and then the resultant is kept as it is for 15 minutes.

After putting the additional amorphous polyester resin dispersion (DA-A15T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA15T-1). When the SEM image of the toner is observed, it is found that the toner has a smooth surface and there is no problem of, for example, protrusion of the release agent and detachment of the surface layers.

<Preparation of Transparent Toner (TNA15T)>

99.0 parts by weight of the obtained transparent toner (TNA15T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA15T). The physical properties of the obtained toner are shown in Table 2.

Example 16

Production of Transparent Toner (TNA16T-1)

The transparent toner (TNA16T-1) obtained in Example 15 is classified by an elbow jet classifier and fine powders thereof are removed to obtain toner particles (TNA16T-1). When the SEM image of the toner is observed, it is found that the toner has a smooth surface and there is no problem of, for example, protrusion of the release agent and detachment of the surface layers.

<Preparation of Transparent Toner (TNA16T)>

99.0 parts by weight of the obtained transparent toner (TNA16T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica thereto, and mixed and blended at 13,000 rpm for 30 seconds (manufactured by Nippon Aerosil Co., Ltd., RY50) are added using a sample mill. Thereafter, the mixture is sieved using a vibrating screen having a pore size of 75 μm to obtain a toner (TNA16T). The physical properties of the obtained toner are shown in Table 3.

Example 17

Production of Transparent Toner (TNA17T-1)

<Preparation of Additional Amorphous Polyester Resin Particle Dispersion (DA-A17T-1)>

Amorphous Polyester Resin Dispersion (DA-A1): 160 parts by weight

Amorphous Polyester Resin Dispersion (DA-A2): 160 parts by weight

Dowfax2A-1 (sodium alkyldiphenyloxide disulfonate, manufactured by The Dow Chemical Company): 0.94 part by weight The above components are put into a beaker, and the pH is adjusted to 4.2 using 1.0%-by-weight aqueous nitric acid solution while stirring the mixture with a magnetic stirrer at a speed not entraining bubbles therein, thereby obtaining an additional amorphous polyester resin particle dispersion (DA-A17T-1).

<Preparation of Aqueous Aluminum Sulfate Solution (SA17T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA17T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 1.77 parts by weight

Ion Exchange Water: 960 parts by weight

The above components are put into a reaction vessel equipped with a thermometer, a pH meter, and a stirrer, and stirred while avoiding the occurrence of a vortex. The pH is adjusted to 4.6 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA17T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 50° C. at a heating rate of 1.0° C./min and then raised at a heating rate of 0.05° C./min. The particle diameters are measured every 10 minutes with a Multisizer and when the volume average particle diameter reaches 20.0 μm, the entire additional amorphous polyester resin dispersion (DA-A17T-1) is further added over 30 minutes and then the resultant is kept as it is for 15 minutes.

After putting the additional amorphous polyester resin dispersion (DA-A17T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA17T-1). When the SEM image of the toner is observed, it is found that the toner has a smooth surface and there is no problem of, for example, protrusion of the release agent and detachment of the surface layers.

<Preparation of Transparent Toner (TNA17T)>

99.0 parts by weight of the obtained transparent toner (TNA17T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 pinto obtain a toner (TNA17T). The physical properties of the obtained toner are shown in Table 3.

Example 18

Production of Transparent Toner (TNA18T-1)

<Preparation of Additional Amorphous Polyester Resin Particle Dispersion (DA-A18T-1)>

Amorphous Polyester Resin Dispersion (DA-A1): 160 parts by weight

Amorphous Polyester Resin Dispersion (DA-A2): 160 parts by weight

Dowfax2A-1: 0.47 part by weight

The above components are put into a beaker, and the pH is adjusted to 4.2 using 1.0%-by-weight aqueous nitric acid solution while stirring the mixture with a magnetic stirrer at a speed not entraining bubbles therein, thereby obtaining an additional amorphous polyester resin particle dispersion (DA-A18T-1).

<Preparation of Aqueous Aluminum Sulfate Solution (SA18T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA18T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 0.8B part by weight

Ion Exchange Water: 1,500 parts by weight

The above components are put into a reaction vessel equipped with a thermometer, a pH meter, and a stirrer, and stirred while avoiding the occurrence of a vortex. The pH is adjusted to 4.6 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA18T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 53° C. at a heating rate of 1.0° C./min and then raised at a heating rate of 0.05° C./rain. The particle diameters are measured every 10 minutes with a Multisizer and when the volume average particle diameter reaches 20.0 μm, the entire additional amorphous polyester resin dispersion (DA-A18T-1) is further added over 30 minutes and then the resultant is kept as it is for 15 minutes.

After putting the additional amorphous polyester resin dispersion (DA-A18T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA18T-1). When the SEM image of the toner is observed, it is found that the toner has a smooth surface and there is no problem of, for example, protrusion of the release agent and detachment of the surface layers.

<Preparation of Transparent Toner (TNA18T)>

99.0 parts by weight of the obtained transparent toner (TNA18T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA18T). The physical properties of the obtained toner are shown in Table 3.

Example 19

Production of Transparent Toner (TNA19T-1)

<Preparation of Additional Amorphous Polyester Resin Particle Dispersion (DA-A19T-1)>

Amorphous Polyester Resin Dispersion (DA-A1): 160 parts by weight

Amorphous Polyester Resin Dispersion (DA-A2): 160 parts by weight

Dowfax2A-1: 0.94 part by weight

The above components are put into a beaker, and the pH is adjusted to 4.2 using 1.0%-by-weight aqueous nitric acid solution while stirring the mixture with a magnetic stirrer at a speed not entraining bubbles therein, thereby obtaining an additional amorphous polyester resin particle dispersion (DA-A19T-1).

<Preparation of Aqueous Aluminum Sulfate Solution (SA19T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA19T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 3.00 parts by weight

Anionic Surfactant (Tayca Power BN2060, manufactured by Tayca Corporation, amount of active ingredients: 60% by weight): 1.67 parts by weight Ion Exchange Water: 880 parts by weight The above components are put into a reaction vessel equipped with a thermometer, a pH meter, and a stirrer, and stirred while avoiding the occurrence of a vortex. The pH is adjusted to 4.6 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA19T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 47° C. at a heating rate of 1.0° C./min and then raised at a heating rate of 0.02° C./min. The particle diameters are measured every 10 minutes with a Multisizer and when the volume average particle diameter reaches 20.0 μm, the entire additional amorphous polyester resin dispersion (DA-A19T-1) is further added over 30 minutes and then the resultant is kept as it is for 15 minutes.

After putting the additional amorphous polyester resin dispersion (DA-A19T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA19T-1). When the SEM image of the toner is observed, it is found that the toner has a smooth surface and there is no problem of, for example, protrusion of the release agent and detachment of the surface layers.

<Preparation of Transparent Toner (TNA19T)>

99.0 parts by weight of the obtained transparent toner (TNA19T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA19T). The physical properties of the obtained toner are shown in Table 3.

Example 20

Production of Transparent Toner (TNA20T-1)

<Preparation of Additional Amorphous Polyester Resin Particle Dispersion (DA-A20T-1)>

- Amorphous Polyester Resin Dispersion (DA-A1): 160 parts by weight
- Amorphous Polyester Resin Dispersion (DA-A2): 160 parts by weight
- Dowfax2A-1: 2.19 parts by weight The above components are put into a beaker, and the pH is adjusted to 4.2 using 1.0%-by-weight aqueous nitric acid solution while stirring the mixture with a magnetic stirrer at a speed not entraining bubbles therein, thereby obtaining an additional amorphous polyester resin particle dispersion (DA-A20T-1).

<Preparation of Aqueous Aluminum Sulfate Solution (SA20T-1)>

- Aluminum sulfate powder (manufactured by Asada Chemical Industry Co., Ltd.: 17% equivalent as $Al_2O_3$, 56.3 to 58.6% equivalent as $Al_2(SO_4)_3$): 1.26 parts by weight
- Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA20T-1)>

- Amorphous Polyester Resin Dispersion (DA-A1): 340 parts by weight
- Amorphous Polyester Resin Dispersion (DA-A2): 340 parts by weight
- Crystalline Polyester Resin Dispersion (DA-C1): 65 parts by weight
- Release Agent Dispersion (DW1): 195 parts by weight
- Dowfax2A-1: 3.00 parts by weight
- Anionic Surfactant (Tayca Power BN2060, manufactured by Tayca Corporation, amount of active ingredients: 60% by weight): 1.67 parts by weight
- Ion Exchange Water: 880 parts by weight The above components are put into a reaction vessel equipped with a thermometer, a pH meter, and a stirrer, and stirred while avoiding the occurrence of a vortex. The pH is adjusted to 4.6 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA20T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 47° C. at a heating rate of 1.0° C./min and then raised at a heating rate of 0.02° C./rain. The particle diameters are measured every 10 minutes with a Multisizer and when the volume average particle diameter reaches 20.0 μm the entire additional amorphous polyester resin dispersion (DA-A20T-1) is further added over 30 minutes and then the resultant is kept as it is for 15 minutes.

After putting the additional amorphous polyester resin dispersion (DA-A20T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA20T-1). When the SEM image of the toner is observed, it is found that the toner has a smooth surface and there is no problem of, for example, protrusion of the release agent and detachment of the surface layers.

<Preparation of Transparent Toner (TNA20T)>

99.0 parts by weight of the obtained transparent toner (TNA20T-1) and 1.0 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA20T). The physical properties of the obtained toner are shown in Table 3.

Example 21

Production of Transparent Toner (TNA21T-1)

<Preparation of Additional Amorphous Polyester Resin Particle Dispersion (DA-A21T-1)>

- Amorphous Polyester Resin Dispersion (DA-A1): 160 parts by weight
- Amorphous Polyester Resin Dispersion (DA-A2): 160 parts by weight
- Dowfax2A-1: 0.94 part by weight The above components are put into a beaker, and the pH is adjusted to 3.8 using 1.0%-by-weight aqueous nitric acid solution while stirring the mixture with a magnetic stirrer at a speed not entraining bubbles therein, thereby obtaining an additional amorphous polyester resin particle dispersion (DA-A21T-1).

<Preparation of Aqueous Aluminum Sulfate Solution (SA21T-1)>

- Aluminum sulfate powder (manufactured by Asada Chemical Industry Co., Ltd.: 17% equivalent as $Al_2O_3$, 56.3 to 58.6% equivalent as $Al_2(SO_4)_3$): 1.28 parts by weight
- Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA21T-1)>

- Amorphous Polyester Resin Dispersion (DA-A1): 340 parts by weight
- Amorphous Polyester Resin Dispersion (DA-A2): 340 parts by weight
- Crystalline Polyester Resin Dispersion (DA-C1): 65 parts by weight
- Release Agent Dispersion (DW1): 195 parts by weight
- Dowfax2A-1: 1.50 parts by weight
- Anionic Surfactant (Tayca Power BN2060, manufactured by Tayca Corporation, amount of active ingredients: 60% by weight): 1.58 parts by weight
- Ion Exchange Water: 720 parts by weight The above components are put into a reaction vessel equipped with a thermometer, a pH meter, and a stirrer, and stirred while avoiding the occurrence of a vortex. The pH is adjusted to 4.5 by the addition of 1.0%-by-weight nitric acid at a temperature of 25° C. Then, while dispersing with a homogenizer (ULTRA TURRAX T50, manufactured by IKA, Japan) at 5,000 rpm, the entire amount of the prepared aqueous aluminum sulfate solution (SA21T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 53° C. at a heating rate of 1.0° C./min and then raised at a heating rate of 0.05° C./rain. The particle diameters are measured every 10 minutes with a Multisizer and when the volume average particle diameter reaches 24.0 μm, the entire additional amorphous polyester resin dispersion (DA-A21T-1) is further added over 30 minutes and then the resultant is kept as it is for 15 minutes.

After putting the additional amorphous polyester resin dispersion (DA-A21T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA21T-1). When the SEM image of the toner is observed, it is found that the toner has a smooth surface and there is no problem of, for example, protrusion of the release agent and detachment of the surface layers.

<Preparation of Transparent Toner (TNA21T)>

99.5 parts by weight of the obtained transparent toner (TNA21T-1) and 0.5 part by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA21T). The physical properties of the obtained toner are shown in Table 3.

Example 22

Production of Transparent Toner (TNA22T-1)

<Preparation of Additional Amorphous Polyester Resin Particle Dispersion (DA-A22T-1)>

Amorphous Polyester Resin Dispersion (DA-A1): 160 parts by weight

Amorphous Polyester Resin Dispersion (DA-A2): 160 parts by weight

Dowfax2A-1: 0.94 part by weight

The above components are put into a beaker, and the pH is adjusted to 3.8 using 1.0%-by-weight aqueous nitric acid solution while stirring the mixture with a magnetic stirrer at a speed not entraining bubbles therein, thereby obtaining an additional amorphous polyester resin particle dispersion (DA-A22T-1).

<Preparation of Aqueous Aluminum Sulfate Solution (SA22T-1)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.28 parts by weight Ion Exchange Water: 15 parts by weight The above components are put into a vessel and mixed with stirring until the precipitates disappear at 30° C., thereby preparing an aqueous aluminum sulfate solution.

<Preparation of Transparent Toner (TNA22T-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 65 parts by weight

Release Agent Dispersion (DW1): 195 parts by weight

Dowfax2A-1: 3.00 parts by weight

Anionic Surfactant (Tayca Power BN2060, manufactured by Tayca Corporation, amount of active ingredients: 60% by weight): 1.58 parts by weight Ion Exchange Water: 480 parts by weight The above components are put into a reaction vessel equipped with a thermometer, a pH meter, and a stirrer, and stirred while avoiding the occurrence of a vortex. The pH is adjusted to 4.5 by the addition of 1.0%-by-weight nitric acid at a temperature of 25° C. Then, while dispersing with a homogenizer (ULTRA TURRAX T50, manufactured by TKA, Japan) at 5,000 rpm, the entire amount of the prepared aqueous aluminum sulfate solution (SA22T-1) is added thereto and dispersed for 6 minutes.

Thereafter, a mantle heater is installed for the reaction vessel, and while adjusting the rotation rate of the stirrer such that the slurry is kept stirred sufficiently, the temperature is raised to 52° C. at a heating rate of 1.0° C./min and then raised at a heating rate of 0.05° C./min. The particle diameters are measured every 10 minutes with a Multisizer and when the volume average particle diameter reaches 16.5 μm, the entire additional amorphous polyester resin dispersion (DA-A22T-1) is further added over 30 minutes and then the resultant is kept as it is for 15 minutes.

After putting the additional amorphous polyester resin dispersion (DA-A22T-1) thereinto, 10 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 92° C. at a heating rate of 1° C./min and kept at 92° C. After the temperature reaches 92° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.950.

The slurry after cooling is passed through a nylon mesh with a pore size of 70 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles (TNA22T-1). When the SEM image of the toner is observed, it is found that the toner has a smooth surface and there is no problem of, for example, protrusion of the release agent and detachment of the surface layers.

<Preparation of Transparent Toner (TNA22T)>

98.8 parts by weight of the obtained transparent toner (TNA22T-1) and 1.2 parts by weight of the transparent toner (TNA1T-2) obtained in Example 1 are put into a sample mill vessel, and 0.1 part by weight of hydrophobic titanium oxide (manufactured by Nippon Aerosil Co., Ltd., P25), 0.15 part by weight of hydrophobic silica (manufactured by Nippon Aerosil Co., Ltd., RX50), and 0.10 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 75 μm to obtain a toner (TNA22T). The physical properties of the obtained toner are shown in Table 3.

Example 23

Production of Color Toner (TNA23K)

<Preparation of Additional Amorphous Polyester Resin Particle Dispersion (DA-A1A)>

Amorphous Polyester Resin Dispersion (DA-A1): 160 parts by weight

Amorphous Polyester Resin Dispersion (DA-A2): 160 parts by weight

Dowfax2A-1: 1.56 parts by weight

The above components are put into a beaker, and the pH is adjusted to 3.5 using 1.0%-by-weight aqueous nitric acid solution while stirring the mixture with a magnetic stirrer at a speed not entraining bubbles therein, thereby obtaining an additional amorphous polyester resin particle dispersion (DA-A1A).

<Preparation of Aqueous Aluminum Sulfate Solution (SA1A)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.38 parts by weight Ion Exchange Water: 20 parts by weight The above components are put into a vessel and mixed with stirring until the precipitates disappear at 30° C., thereby preparing an aqueous aluminum sulfate solution.

<Preparation of Color Toner (TNA23K)>

Amorphous Polyester Resin Dispersion (DA-A1): 315 parts by weight

Amorphous Polyester Resin Dispersion (DA-A2): 315 parts by weight

Crystalline Polyester Resin Dispersion (DA-C1): 61 parts by weight

Release Agent Dispersion (DW1): 130 parts by weight

Colorant Dispersion (PDK1): 180 parts by weight

Dowfax2A-1: 3.38 parts by weight

Ion Exchange Water: 380 parts by weight

The above components are put into a reaction vessel equipped with a thermometer, a pH meter, and a stirrer, and stirred while avoiding the occurrence of a vortex. The pH is adjusted to 4.0 by the addition of 1.0%-by-weight nitric acid at a temperature of 25° C. Then, while dispersing with a homogenizer (ULTRA TURRAX T50, manufactured by IKA, Japan) at 6,000 rpm, the entire amount of the prepared aqueous aluminum sulfate solution (SA1A) is added thereto and dispersed for 6 minutes.

Thereafter, a mantle heater is installed for the reaction vessel, and while adjusting the rotation rate of the stirrer such that the slurry is kept stirred sufficiently, the temperature is raised to 38° C. at a heating rate of 1.0° C./min and then raised at a heating rate of 0.05° C./min. The particle diameters are measured every 10 minutes with a Multisizer and when the volume average particle diameter reaches 3.2 the entire additional amorphous polyester resin dispersion (DA-A1A) is further added over 30 minutes and then the resultant is kept as it is for 15 minutes.

After putting the additional amorphous polyester resin dispersion (DA-A1A) thereinto, 9 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 85° C. at a heating rate of 1° C./min and kept at 85° C. After the temperature reaches 85° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.970.

The slurry after cooling is passed through a nylon mesh with a pore size of 15 μm the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles. With respect to 100 parts of weight of the obtained toner particles, 1.6 parts by weight of hydrophobic titanium oxide (manufactured by Nippon Aerosil Co., Ltd., P25), 1.7 parts by weight of hydrophobic silica (manufactured by Nippon Aerosil Co., Ltd., RX50), and 0.85 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 95 μm to obtain a toner (TNA23K). When the SEM image of the toner is observed, it is found that the toner has a smooth surface and there is no problem of, for example, protrusion of the release agent and detachment of the surface layers. The physical properties of the obtained toner are shown in Table 3.

<Preparation of Developer (DTNA23K)>

35 parts by weight of the toner (TNA23K) is added to 500 parts by weight of the resin-coated carrier (C-2) obtained in Example 1, and blended using a V-type blender for 20 minutes, and the aggregates are then removed by a vibrating screen having a pore size of 212 μm to prepare a developer (DTNA23K).

Example 24

Production of Color Toner (TNA24K)

<Preparation of Additional Amorphous Polyester Resin Particle Dispersion (DA-A1A)>

Amorphous Polyester Resin Dispersion (DA-A1): 160 parts by weight

Amorphous Polyester Resin Dispersion (DA-A2): 160 parts by weight

Dowfax2A-1: 1.56 parts by weight

The above components are put into a beaker, and the pH is adjusted to 3.5 using 1.0%-by-weight aqueous nitric acid solution while stirring the mixture with a magnetic stirrer at a speed not entraining bubbles therein, thereby obtaining an additional amorphous polyester resin particle dispersion (DA-A1A).

<Preparation of Aqueous Aluminum Sulfate Solution (SA1A)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.28 parts by weight Ion Exchange Water: 20 parts by weight The above components are put into a vessel and mixed with stirring until the precipitates disappear at 30° C., thereby preparing an aqueous aluminum sulfate solution.

<Preparation of Color Toner (TNA24K)>

Amorphous Polyester Resin Dispersion (DA-A1): 330 parts by weight

Amorphous Polyester Resin Dispersion (DA-A2): 330 parts by weight

Crystalline Polyester Resin Dispersion (DA-C1): 62 parts by weight

Release Agent Dispersion (DW1): 130 parts by weight

Colorant Dispersion (PDK1): 135 parts by weight

Dowfax2A-1: 3.38 parts by weight

Ion Exchange Water: 440 parts by weight

The above components are put into a reaction vessel equipped with a thermometer, a pH meter, and a stirrer, and stirred while avoiding the occurrence of a vortex. The pH is adjusted to 4.0 by the addition of 1.0%-by-weight nitric acid at a temperature of 25° C. Then, while dispersing with a homogenizer (ULTRA TURRAX T50, manufactured by IKA, Japan) at 6,000 rpm, the entire amount of the prepared aqueous aluminum sulfate solution (SA1A) is added thereto and dispersed for 6 minutes.

Thereafter, a mantle heater is installed for the reaction vessel, and while adjusting the rotation rate of the stirrer such that the slurry is kept stirred sufficiently, the temperature is raised to 40° C. at a heating rate of 1.0° C./min and then raised at a heating rate of 0.05° C./min. The particle diameters are measured every 10 minutes with a Multisizer and when the volume average particle diameter reaches 4.2 μm, the entire additional amorphous polyester resin dispersion (DA-A1A) is further added over 30 minutes and then the resultant is kept as it is for 15 minutes.

After putting the additional amorphous polyester resin dispersion (DA-A1A) thereinto, 9 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 85° C. at a heating rate of 1° C./min and kept at 85° C. After the temperature reaches 85° C., the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.970.

The slurry after cooling is passed through a nylon mesh with a pore size of 15 μm, the coarse powder is removed, and the toner slurry passed through the mesh is filtered under reduced pressure with an aspirator to carry out solid-liquid separation. The toner remaining on the filter paper is pulverized as fine as possible by hand, put into ion exchange water of 10 times the amount of the toner at a temperature of 30° C., mixed with stirring for 30 minutes, and again subjected to solid-liquid separation with an aspirator. This operation is repeated until the electrical conductivity of the filtrate is equal to or less than 10 μS/cm, and the toner is washed.

The washed toner is finely pulverized with a wet-type/dry-type granulating machine (Comil), and dried by vacuum drying in an oven at 35° C. for 36 hours to obtain toner particles. With respect to 100 parts by weight of the obtained toner particles, 1.2 parts by weight of hydrophobic titanium oxide (manufactured by Nippon Aerosil Co., Ltd., P25), 1.3 parts by weight of hydrophobic silica (manufactured by Nippon Aerosil Co., Ltd., RX50), and 0.60 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 45 μm to obtain a toner (TNA24K). When the SEM image of the toner is observed, it is found that the toner has a smooth surface and there is no problem of, for example, protrusion of the release agent and detachment of the surface layers. The physical properties of the obtained toner are shown in Table 3.

<Preparation of Developer (DTNA24K)>

35 parts by weight of the toner (TNA24K) is added to 500 parts by weight of the resin-coated carrier (C-2) obtained in Example 1, and blended using a V-type blender for 20 minutes, and the aggregates are then removed by a vibrating screen having a pore size of 212 μm to prepare a developer (DTNA24K).

Example 25

Production of Color Toner (TNA25K-1)

<Preparation of Additional Amorphous Polyester Resin Particle Dispersion (DA-A1A)>

Amorphous Polyester Resin Dispersion (DA-A1): 160 parts by weight

Amorphous Polyester Resin Dispersion (DA-A2): 160 parts by weight

Dowfax2A-1: 1.56 parts by weight

The above components are put into a beaker, and the pH is adjusted to 3.5 using 1.0%-by-weight aqueous nitric acid solution while stirring the mixture with a magnetic stirrer at a speed not entraining bubbles therein, thereby obtaining an additional amorphous polyester resin particle dispersion (DA-A1A).

<Preparation of Aqueous Aluminum Sulfate Solution (SA1A)>

Aluminum sulfate powder (manufactured by Asada Chemical Industry Co., Ltd.: 17% equivalent as $Al_2O_3$, 56.3 to 58.6% equivalent as $Al_2(SO_4)_3$): 1.28 parts by weight Ion Exchange Water: 20 parts by weight The above components are put into a vessel and mixed with stirring until the precipitates disappear at 30° C., thereby preparing an aqueous aluminum sulfate solution.

<Preparation of Color Toner (TNA25K-1)>

Amorphous Polyester Resin Dispersion (DA-A1): 340 parts by weight

Amorphous Polyester Resin Dispersion (DA-A2): 340 parts by weight

Crystalline Polyester Resin Dispersion (DA-C1): 62 parts by weight

Release Agent Dispersion (DW1): 130 parts by weight

Colorant Dispersion (PDK1): 130 parts by weight

Dowfax2A-1: 1.66 parts by weight

Ion Exchange Water: 440 parts by weight

The above components are put into a reaction vessel equipped with a thermometer, a pH meter, and a stirrer, and stirred while avoiding the occurrence of a vortex. The pH is adjusted to 4.0 by the addition of 1.0%-by-weight nitric acid at a temperature of 25° C. Then, while dispersing with a homogenizer (ULTRA TURRAX T50, manufactured by IKA, Japan) at 6,000 rpm, the entire amount of the prepared aqueous aluminum sulfate solution (SA1A) is added thereto and dispersed for 6 minutes.

Thereafter, a mantle heater is installed for the reaction vessel, and while adjusting the rotation rate of the stirrer such that the slurry is kept stirred sufficiently, the temperature is raised to 40° C. at a heating rate of 1.0° C./min and then raised at a heating rate of 0.05° C./min. The particle diameters are measured every 10 minutes with a Multisizer and when the volume average particle diameter reaches 4.4 μm, the entire additional amorphous polyester resin dispersion (DA-A1A) is further added over 30 minutes and then the resultant is kept as it is for 15 minutes.

After putting the additional amorphous polyester resin dispersion (DA-A1A) thereinto, 9 parts by weight of EDTA (manufactured by Chelest Corporation, Chelest 40, active ingredient 40% by weight) is added thereto over 5 minutes and the pH is adjusted to 8.5 with a 1%-by-weight aqueous sodium hydroxide solution.

Thereafter, the pH is adjusted to 8.5 with a 1%-by-weight aqueous sodium hydroxide solution after every temperature raise of 5° C., and the temperature is raised to 85° C. at a heating rate of 1° C./min and kept at 85° C. After the temperature reaches 85° C., the pH is adjusted to 8.0 using a 1.0%-by-weight aqueous nitric acid solution, and then the pH is lowered by 0.05 using a 1.0%-by-weight aqueous nitric acid solution every 10 minutes, the shape factor is measured with an FPIA-3000 (manufactured by Sysmex Corp.), and the vessel is cooled to 30° C. over 5 minutes with cooling water when the average shape factor reaches 0.960.

The slurry after cooling is passed through a nylon mesh with a pore size of 20 μm, the coarse powder is removed, and after the slurry is passed through a nylon mesh with a pore size of 10 μm, the slurry remaining on the mesh is collected. The collected slurry is pulverized and then put into 1,000 parts by weight of ion exchange water, mixed with stirring for 30 minutes, and then subjected to solid-liquid separation with an aspirator. This operation is repeated until the electrical conductivity of the filtrate is equal to or less than 10 μS/cm, and the toner is washed. The washed toner is finely pulverized with a wet-type/dry-type granulating machine (Comic), and dried by vacuum drying in an oven at 35° C. for 36 hours to obtain a toner (TNA25K-1).

<Preparation of Color Toner (TNA25T)>

99.5 parts by weight of the color toner (TNA1K) obtained in Example 1 and 0.5 part by weight of the color toner (TNA25K-1) are put into a sample mill vessel, and 1.0 part by weight of hydrophobic titanium oxide (manufactured by Nippon Aerosil Co., Ltd., P25), 1.0 part by weight of hydrophobic silica (manufactured by Nippon Aerosil Co., Ltd., RX50), and 0.5 part by weight of hydrophobic silica (manufactured by Nippon Aerosil Co., Ltd., RY50) are added thereto, and mixed and blended at 13,000 rpm for 30 seconds using a sample mill. Thereafter, the mixture is sieved using a vibrating screen having a pore size of 45 μm to obtain a toner (TNA25K). The physical properties of the obtained toner are shown in Table 3.

<Preparation of Developer (DTNA25K)>

40 parts by weight of the toner (TNA25K) is added to 500 parts by weight of the resin-coated carrier (C-2) obtained in Example 1, and blended using a V-type blender for 20 minutes, and the aggregates are then removed by a vibrating screen having a pore size of 212 μm to prepare a developer (DTNA25K).

Example 26

By the same operation as in <Preparation of Color Toner (TNA25T)> of Example 25, except that the amount of the color toner (TNA1K) obtained in Example 1 is changed to 99.4 parts by weight and the amount of the color toner (TNA25K-1) is changed to 0.6 part by weight, a toner (TNA26K) is obtained. The physical properties of the obtained toner are shown in Table 3.

<Preparation of Developer (DTNA26K)>

40 parts by weight of the toner (TNA26K) is added to 500 parts by weight of the resin-coated carrier (C-2) obtained in Example 1, and blended using a V-type blender for 20 minutes, and the aggregates are then removed by a vibrating screen having a pore size of 212 μm to prepare a developer (DTNA26K).

Comparative Example 1

By the same method as Example 1, except that the amount of the transparent toner (TNA1T-1) is changed to 97.3 parts by weight and the amount of the transparent toner (TNA1T-2) is changed to 2.7 parts by weight in the preparation of the transparent toner (TNA1T) of Example 1, a transparent toner (TNB1T) and a transparent toner developer (DTNB1T) are obtained. The physical properties of the obtained toner are shown in Table 3.

Comparative Example 2

By the same method as Example 1, except that the amount of the transparent toner (TNA1T-1) is changed to 100 parts by weight and the transparent toner (TNA1T-2) is not mixed therewith in the preparation of the transparent toner (TNA1T) of Example 1, a transparent toner (TNB2T) and a transparent toner developer (DTNB2T) are obtained. The physical properties of the obtained toner are shown in Table 3.

Comparative Example 3

By the same procedure as in Example 8, except that the amount of the transparent toner (TNA8T-1) obtained in the preparation of the transparent toner (TNA8T) of Example 8 is changed to 2.1 parts by weight, the amount of the transparent toner (TNA1T-1) obtained in Example 1 is changed to 97.5 parts by weight, and the amount of the transparent toner (TNA1T-2) is changed to 1.4 parts by weight, a toner (TNB3T) and a developer (DTNB3T) are obtained. The physical properties of the obtained toner are shown in Table 3.

Comparative Example 4

Production of Transparent Toner (TNB4T)

- Amorphous Polyester Resin (PEA-A1): 600 parts by weight
- Amorphous Polyester Resin Dispersion (PEA-A2): 600 parts by weight
- Crystalline Polyester Resin Dispersion (PEA-C1): 75 parts by weight
- Hydrocarbon-based wax (manufactured by Nippon Seiro Co., Ltd., trade name: FNP0090, melting temperature Tw=90.2° C.): 150 parts by weight
- Carbon Black (manufactured by Cabot Japan Corporation, REAGAL330): 75 parts by weight
- FTR2120 (manufactured by Mitsui Chemicals, Inc.): 15 parts by weight The above components are mixed with a Henschel mixer, and then melt-kneaded at a rotation speed of 120 rpm with a BR-type, Banbury-type kneader (manufactured by Kobe Steel., Ltd.) for about 15 minutes. The kneaded product is molded to a plate having a thickness of about 1 cm with a rolling roll, coarsely pulverized to a few millimeters with a fitz-mill-type pulverizer, finely pulverized with an IDS-type pulverizer, and sequentially classified with an elbow-type classifier to obtain a transparent toner (TNB4T).

<Preparation of Developer (DTNB4T)>

40 parts by weight of the toner (TNB4T) is added to 500 parts by weight of the resin-coated carrier (C) of Example 1, and blended using a V-type blender for 20 minutes, and the aggregates are then removed by a vibrating screen having a pore size of 212 μm to prepare a developer (DTNB4T).

TABLE 2

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Method for preparing color toner | PEA | PEA | PEA | PEA | PEA | PEA | PEA | PEA |
| Name of color toner | TNA1K | TNA1K | TNA1K | TNA1K | TNA1K | TNA1K | TNA1K | TNA1K |
| Volume average particle diameter Dc (μm) of color toner | 5.8 | 5.8 | 5.8 | 5.8 | 5.8 | 5.8 | 5.8 | 5.8 |
| Proportion (% by number) of particles of color toner having circularity of 0.6 to 0.9 | 0 | 0 | 0 | 0 | 0 | 0 | 0 | 0 |
| Shape factor SF1 of color toner | 131 | 131 | 131 | 131 | 131 | 131 | 131 | 131 |
| Particle diameter distribution GSDPc of color toner | 1.22 | 1.22 | 1.22 | 1.22 | 1.22 | 1.22 | 1.22 | 1.22 |
| Content Sc (%) of S of color toner | 0.11 | 0.11 | 0.11 | 0.11 | 0.11 | 0.11 | 0.11 | 0.11 |
| Method for preparing transparent toner | PEA | PEA | PEA | PEA | PEA | PEA | PEA | PEA |
| Name of transparent toner | TNA1T | TNA2T | TNA3T | TNA4T | TNA5T | TNA6T | TNA7T | TNA8T |
| Volume average particle diameter Dt (μm) of transparent toner | 22.6 | 22.5 | 22.5 | 22.5 | 22.5 | 22.5 | 22.4 | 22.7 |
| Nta of transparent toner | 3880 | 3865 | 3878 | 3877 | 3922 | 3868 | 3915 | 3784 |
| Ntb of transparent toner | 97 | 58 | 46 | 39 | 32 | 20 | 4 | 88 |
| Ntc of transparent toner | 0 | 0 | 0 | 0 | 0 | 0 | 0 | 37 |
| Shape factor SF1 of transparent toner | 129 | 129 | 129 | 129 | 129 | 129 | 129 | 129 |
| Particle diameter distribution GSDPt of transparent toner | 1.28 | 1.28 | 1.28 | 1.28 | 1.28 | 1.28 | 1.28 | 1.28 |
| Content St (%) of S of transparent toner | 0.04 | 0.04 | 0.04 | 0.04 | 0.04 | 0.04 | 0.04 | 0.04 |
| Ntb/Nta × 100 of transparent toner | 2.50 | 1.50 | 1.19 | 1.01 | 0.82 | 0.52 | 0.10 | 2.33 |
| Ntc/Nta × 100 of transparent toner | 0.00 | 0.00 | 0.00 | 0.00 | 0.00 | 0.00 | 0.00 | 0.98 |
| St/Sc | 0.36 | 0.36 | 0.36 | 0.36 | 0.36 | 0.36 | 0.36 | 0.36 |
| Dt/Dc | 3.90 | 3.88 | 3.88 | 3.88 | 3.88 | 3.88 | 3.86 | 3.91 |
| GSDPt/GSDPc | 1.05 | 1.05 | 1.05 | 1.05 | 1.05 | 1.05 | 1.05 | 1.05 |
| Edge sharpness X2-X1 | C | B | B | A | B | B | B | C |

| | Ex. 9 | Ex. 10 | Ex. 11 | Ex. 12 | Ex. 13 | Ex. 14 | Ex. 15 |
|---|---|---|---|---|---|---|---|
| Method for preparing color toner | PEA | PEA | PEA | PEA | PEA | PEA | PEA |
| Name of color toner | TNA1K | TNA1K | TNA1K | TNA1K | TNA1K | TNA1K | TNA1K |
| Volume average particle diameter Dc (μm) of color toner | 5.8 | 5.8 | 5.8 | 5.8 | 5.8 | 5.8 | 5.8 |
| Proportion (% by number) of particles of color toner having circularity of 0.6 to 0.9 | 0 | 0 | 0 | 0 | 0 | 0 | 0 |
| Shape factor SF1 of color toner | 131 | 131 | 131 | 131 | 131 | 131 | 131 |
| Particle diameter distribution GSDPc of color toner | 1.22 | 1.22 | 1.22 | 1.22 | 1.22 | 1.22 | 1.22 |
| Content Sc (%) of S of color toner | 0.11 | 0.11 | 0.11 | 0.11 | 0.11 | 0.11 | 0.11 |
| Method for preparing transparent toner | PEA | PEA | PEA | PEA | PEA | PEA | PEA |
| Name of transparent toner | TNA9T | TNA10T | TNA11T | TNA12T | TNA13T | TNA14T | TNA15T |
| Volume average particle diameter Dt (μm) of transparent toner | 22.7 | 22.6 | 22.5 | 22.5 | 23.3 | 22.9 | 22.3 |
| Nta of transparent toner | 3802 | 3819 | 3835 | 3863 | 4330 | 4127 | 3626 |
| Ntb of transparent toner | 41 | 43 | 41 | 42 | 35 | 39 | 34 |
| Ntc of transparent toner | 19 | 13 | 8 | 2 | 0 | 0 | 0 |
| Shape factor SF1 of transparent toner | 129 | 129 | 129 | 129 | 128 | 130 | 130 |
| Particle diameter distribution GSDPt of transparent toner | 1.28 | 1.28 | 1.28 | 1.28 | 1.46 | 1.35 | 1.25 |
| Content St (%) of S of transparent toner | 0.04 | 0.04 | 0.04 | 0.04 | 0.08 | 0.07 | 0.05 |
| Ntb/Nta × 100 of transparent toner | 1.08 | 1.13 | 1.07 | 1.09 | 0.81 | 0.94 | 0.94 |
| Ntc/Nta × 100 of transparent toner | 0.50 | 0.34 | 0.21 | 0.05 | 0.00 | 0.00 | 0.00 |
| St/Sc | 0.36 | 0.36 | 0.36 | 0.36 | 0.73 | 0.64 | 0.45 |
| Dt/Dc | 3.91 | 3.90 | 3.88 | 3.88 | 4.02 | 3.95 | 3.84 |
| GSDPt/GSDPc | 1.05 | 1.05 | 1.05 | 1.05 | 1.20 | 1.11 | 1.02 |
| Edge sharpness X2-X1 | B | B | B | A | C | B | B |

TABLE 3

| | Ex. 16 | Ex. 17 | Ex. 18 | Ex. 19 | Ex. 20 | Ex. 21 | Ex. 22 | Ex. 23 |
|---|---|---|---|---|---|---|---|---|
| Method for preparing color toner | PEA | PEA | PEA | PEA | PEA | PEA | PEA | PEA |
| Name of color toner | TNA1K | TNA1K | TNA1K | TNA1K | TNA1K | TNA1K | TNA1K | TNA23K |
| Volume average particle diameter Dc (μm) of color toner | 5.8 | 5.8 | 5.8 | 5.8 | 5.8 | 5.8 | 5.8 | 3.5 |
| Proportion (% by number) of particles of color toner having circularity of 0.6 to 0.9 | 0 | 0 | 0 | 0 | 0 | 0 | 0 | 0 |
| Shape factor SF1 of color toner | 131 | 131 | 131 | 131 | 131 | 131 | 131 | 131 |
| Particle diameter distribution GSDPc of color toner | 1.22 | 1.22 | 1.22 | 1.22 | 1.22 | 1.22 | 1.22 | 1.22 |
| Content Sc (%) of S of color toner | 0.11 | 0.11 | 0.11 | 0.11 | 0.11 | 0.11 | 0.11 | 0.12 |

TABLE 3-continued

| | | | | | | | | |
|---|---|---|---|---|---|---|---|---|
| Method for preparing transparent toner | PEA | PEA | PEA | PEA | PEA | PEA | PEA | PEA |
| Name of transparent toner | TNA16T | TNA17T | TNA18T | TNA19T | TNA20T | TNA21T | TNA22T | TNA21T |
| Volume average particle diameter Dt (μm) of transparent toner | 21.9 | 22.6 | 22.8 | 22.2 | 21.9 | 27.8 | 18.1 | 27.8 |
| Nta of transparent toner | 3489 | 3993 | 4077 | 3962 | 4166 | 2230 | 5335 | 2230 |
| Ntb of transparent toner | 37 | 38 | 54 | 36 | 38 | 18 | 48 | 18 |
| Ntc of transparent toner | 0 | 0 | 1 | 0 | 0 | 0 | 0 | 0 |
| Shape factor SF1 of transparent toner | 129 | 129 | 129 | 129 | 129 | 125 | 135 | 125 |
| Particle diameter distribution GSDPt of transparent toner | 1.2 | 1.31 | 1.32 | 1.3 | 1.31 | 1.33 | 1.27 | 1.33 |
| Content St (%) of S of transparent toner | 0.05 | 0.01 | 0.00 | 0.08 | 0.10 | 0.05 | 0.07 | 0.05 |
| Ntb/Nta × 100 of transparent toner | 1.06 | 0.95 | 1.32 | 0.91 | 0.91 | 0.81 | 0.90 | 0.81 |
| Ntc/Nta × 100 of transparent toner | 0.00 | 0.00 | 0.02 | 0.00 | 0.00 | 0.00 | 0.00 | 0.00 |
| St/Sc | 0.45 | 0.09 | 0.00 | 0.73 | 0.91 | 0.45 | 0.64 | 0.42 |
| Dt/Dc | 3.78 | 3.90 | 3.93 | 3.83 | 3.78 | 4.79 | 3.12 | 7.94 |
| GSDPt/GSDPc | 0.98 | 1.07 | 1.08 | 1.07 | 1.07 | 1.09 | 1.04 | 1.09 |
| Edge sharpness X2-X1 | B | C | C | B | C | B | C | C |

| | Ex. 24 | Ex. 25 | Ex. 26 | Comparative Ex. 1 | Comparative Ex. 2 | Comparative Ex. 3 | Comparative Ex. 4 |
|---|---|---|---|---|---|---|---|
| Method for preparing color toner | PEA | PEA | PEA | PEA | PEA | PEA | PEA |
| Name of color toner | TNA24K | TNA25K | TNA26K | TNA1K | TNA1K | TNA1K | TNA1K |
| Volume average particle diameter Dc (μm) of color toner | 4.7 | 5.8 | 5.8 | 5.8 | 5.8 | 5.8 | 5.8 |
| Proportion (% by number) of particles of color toner having circularity of 0.6 to 0.9 | 0 | 0.5 | 0.6 | 0 | 0 | 0 | 0 |
| Shape factor SF1 of color toner | 131 | 131 | 131 | 131 | 131 | 131 | 131 |
| Particle diameter distribution GSDPc of color toner | 1.22 | 1.22 | 1.22 | 1.22 | 1.22 | 1.22 | 1.22 |
| Content Sc (%) of S of color toner | 0.11 | 0.11 | 0.11 | 0.11 | 0.11 | 0.11 | 0.11 |
| Method for preparing transparent toner | PEA | PEA | PEA | PEA | PEA | PEA | Kneading |
| Name of transparent toner | TNA21T | TNA21T | TNA21T | TNB1T | TNB2T | TNB3T | TNB4T |
| Volume average particle diameter Dt (μm) of transparent toner | 27.8 | 27.8 | 27.8 | 22.6 | 22.4 | 22.8 | 23.3 |
| Nta of transparent toner | 2230 | 2230 | 2230 | 3909 | 3904 | 3699 | 3154 |
| Ntb of transparent toner | 18 | 18 | 18 | 103 | 0 | 53 | 179 |
| Ntc of transparent toner | 0 | 0 | 0 | 0 | 0 | 41 | 7 |
| Shape factor SF1 of transparent toner | 125 | 125 | 125 | 129 | 129 | 129 | 155 |
| Particle diameter distribution GSDPt of transparent toner | 1.33 | 1.33 | 1.33 | 1.28 | 1.28 | 1.28 | 1.45 |
| Content St (%) of S of transparent toner | 0.05 | 0.05 | 0.05 | 0.04 | 0.04 | 0.04 | 0.00 |
| Ntb/Nta × 100 of transparent toner | 0.81 | 0.81 | 0.81 | 2.63 | 0.00 | 1.43 | 5.68 |
| Ntc/Nta × 100 of transparent toner | 0.00 | 0.00 | 0.00 | 0.00 | 0.00 | 1.11 | 0.22 |
| St/Sc | 0.45 | 0.45 | 0.45 | 0.36 | 0.36 | 0.36 | 0.00 |
| Dt/Dc | 5.91 | 4.79 | 4.79 | 3.90 | 3.86 | 3.93 | 4.02 |
| GSDPt/GSDPc | 1.09 | 1.09 | 1.09 | 1.05 | 1.05 | 1.05 | 1.19 |
| Edge sharpness X2-X1 | C | B | C | D | D | D | D |

Further, as used in Tables 2 and 3, "PEA" refers to a polyester aggregation method, and "kneading" refers to a kneading-pulverizing method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transparent toner comprising:

toner particles having a volume average particle diameter in the range of from 18 μm to 28 μm, and satisfying the following formulae (1) and (2):

$$0.1 \leq Ntb/Nta \times 100 \leq 2.5 \quad (1)$$

$$0 \leq Ntc/Nta \times 100 \leq 1.0 \quad (2)$$

wherein Nta is the number of particles under the measurement conditions satisfying 0.5 μm≤circle-equivalent diameter≤200 μm, and 0.40≤circularity≤1.00;

Ntb is the number of particles under the measurement conditions satisfying 0.5×Dta (μm)≤circle-equivalent diameter≤2.5×Dta (μm), and 0.60≤circularity≤0.90; and Ntc is the number of particles under the measurement conditions satisfying 2.5×Dta (μm)≤circle-equivalent diameter≤200 μm, and 0.40≤circularity≤1.00; and Dta is the average circle-equivalent diameter under the measurement conditions satisfying 0.5 μm≤circle-equivalent diameter≤200 μm, and 0.40≤circularity≤1.00.

2. The transparent toner according to claim 1, wherein a number particle diameter distribution GSDPt of the transparent toner is in the range of from 1.20 to 1.50.

3. The transparent toner according to claim 1, wherein a content (compositional ratio) of elemental sulfur as measured by fluorescent X-rays is in the range of from 0.01 to 0.10%.

4. The transparent toner according to claim 1, which satisfies the following formulae:

$$0.5 \leq Ntb/Nta \times 100 \leq 1.5 \quad (3)$$

$$0 \leq Ntc/Nta \times 100 \leq 0.5 \quad (4).$$

5. The transparent toner according to claim 1, which satisfies the following formulae:

$$0.8 \leq Ntb/Nta \times 100 \leq 1.2 \quad (5)$$

$$0 \leq Ntc/Nta \times 100 \leq 0.2 \quad (6).$$

6. The transparent toner according to claim 1, wherein the transparent toner contains a colorant in an amount of equal to or less than 1% by weight.

7. The transparent toner according to claim 1, wherein the volume average particle diameter of the transparent toner is in the range of from 18 μm to 24 μm.

8. The transparent toner according to claim 1, wherein a number particle diameter distribution GSDPt of the transparent toner is in the range of from 1.25 to 1.35.

9. An image forming method comprising:

charging a surface of an image holding member;

forming an electrostatic latent image on the surface of the image holding member;

developing the electrostatic latent image formed on the surface of the image holding member using a developer to form a toner image; and transferring the toner image to a transfer member, wherein the forming of the toner image involves the use of the transparent toner according to claim 1 and a color toner, the color toner has a proportion of particles having a circularity of from 0.7 to 0.9 in the range of from 0 to 0.5% by number in the shape factor distribution, and the toners satisfy the following formulae:

$$3\ \mu m \leq Dc \leq 8\ \mu m \quad (7)$$

$$18\ \mu m \leq Dt \leq 28\ \mu m \quad (8)$$

$$3 \leq Dt/Dc \leq 8 \quad (9)$$

wherein Dc represents the volume average particle diameter of the color toner and Dt represents the volume average particle diameter of the transparent toner.

10. The image forming method according to claim 9, wherein the transparent toner and the color toner satisfy the following formula:

$$0.1 \leq St/Sc \leq 1.0 \quad (10)$$

wherein St represents the content (compositional ratio) of elemental sulfur of the transparent toner as measured by fluorescent X-rays and Sc represents the content (compositional ratio) of elemental sulfur of the color toner as measured by fluorescent X-rays.

11. The image forming method according to claim 9, wherein the transparent toner has a content (compositional ratio) of the elemental sulfur as measured by fluorescent X-rays in the range of from 0.01% to 0.10%.

12. The image forming method according to claim 9, wherein the transparent toner has a number particle diameter distribution GSDPt in the range of from 1.20 to 1.50.

13. A toner set comprising:

a transparent toner; and a colored toner, wherein the transparent toner is the transparent toner according to claim 1, the color toner has a proportion of particles having a circularity of from 0.7 to 0.9 in the range of from 0 to 0.5% by number in the shape factor distribution, and the toner set satisfies the following formulae:

$$3\ \mu m \leq Dc \leq 8\ \mu m \quad (7)$$

$$18\ \mu m \leq Dt \leq 28\ \mu m \quad (8)$$

$$3 \leq Dt/Dc \leq 8 \quad (9)$$

wherein Dc represents the volume average particle diameter of the color toner and Dt represents the volume average particle diameter of the transparent toner.

14. The toner set according to claim 13, wherein the transparent toner and the color toner satisfy the following formula:

$$0.1 \leq St/Sc \leq 1.0 \quad (10)$$

wherein St represents the content (compositional ratio) of elemental sulfur of the transparent toner as measured by fluorescent X-rays and Sc represents the content (compositional ratio) of elemental sulfur of the color toner as measured by fluorescent X-rays.

15. The toner set according to claim 13, wherein the transparent toner has a content (compositional ratio) of the elemental sulfur as measured by fluorescent X-rays in the range of from 0.01% to 0.10%.

16. The toner set according to claim 13, wherein the transparent toner has a number particle diameter distribution GSDPt in the range of from 1.20 to 1.50.

17. The toner set according to claim 13, wherein the transparent toner contains a colorant in an amount of equal to or less than 1% by weight.

* * * * *